US006431046B1

(12) United States Patent
Okpokowuruk

(10) Patent No.: US 6,431,046 B1
(45) Date of Patent: Aug. 13, 2002

(54) PNEUMATIC MOTOR

(75) Inventor: Paul Okpokowuruk, Charlotte, NC (US)

(73) Assignee: Alemite Corporation, Charlotte, NC (US)

( * ) Notice: Subject to any disclaimer, the term of this patent is extended or adjusted under 35 U.S.C. 154(b) by 49 days.

(21) Appl. No.: 09/695,833

(22) Filed: Oct. 25, 2000

(51) Int. Cl.[7] ..... F01L 25/02
(52) U.S. Cl. ..... 91/308; 137/625.63
(58) Field of Search ..... 91/276, 302, 290, 91/308; 137/625.63, 625.6

(56) References Cited

U.S. PATENT DOCUMENTS

| | | | | |
|---|---|---|---|---|
| 410,408 | A | 9/1889 | Fox | |
| 1,140,532 | A | 5/1915 | Rizer | |
| 1,222,863 | A | 4/1917 | Hart | |
| 1,684,752 | A | 9/1928 | Wilhelm | |
| 1,711,811 | A | 5/1929 | Rudlin | |
| 1,740,713 | A | 12/1929 | Rundqvist | |
| 1,813,773 | A | 7/1931 | Smith, Jr. | |
| 1,952,690 | A | 3/1934 | Strom, Sr. | 121/158 |
| 2,296,647 | A | 9/1942 | McCormick | 121/157 |
| 2,466,041 | A | 4/1949 | Peoples, Jr. et al. | 121/41 |
| 2,583,285 | A | 1/1952 | Zehnder | 230/52 |
| 3,009,447 | A | 11/1961 | Lloyd | 121/41 |
| 3,095,906 | A | 7/1963 | Kolm, Jr. | 137/625.62 |
| 3,160,071 | A | 12/1964 | Kandelman | 91/51 |
| 3,185,040 | A | 5/1965 | Ligon | 91/277 |
| 3,200,713 | A | 8/1965 | Viersma et al. | 91/49 |
| 3,283,667 | A | 11/1966 | Andersen | 91/39 |
| 3,516,763 | A | 6/1970 | Manton | 417/403 |
| 3,552,433 | A | 1/1971 | Mason | 137/553 |
| 3,720,137 | A | 3/1973 | Landherr et al. | 91/279 |
| 3,916,765 | A | 11/1975 | Hilton | 91/307 |
| 4,212,597 | A | 7/1980 | Gali Mallofre | 417/225 |
| 4,491,055 | A | 1/1985 | Dollison | 91/306 |
| 4,593,712 | A | 6/1986 | Quartana, III | 137/106 |
| 4,756,230 | A | 7/1988 | Shew | 91/55 |
| 4,776,773 | A | 10/1988 | Quartana, III | 417/390 |
| 4,780,065 | A | 10/1988 | Sayers | 417/403 |
| 4,846,045 | A | 7/1989 | Grach et al. | 91/306 |
| 4,870,891 | A | 10/1989 | Shew et al. | 91/291 |
| 5,092,746 | A | 3/1992 | Henke | 417/403 |
| 5,170,691 | A | 12/1992 | Baatrup | 91/287 |
| 5,435,703 | A | 7/1995 | Lin | 417/428 |
| 5,449,278 | A | 9/1995 | Lin | 417/526 |
| 5,468,127 | A | 11/1995 | Elliott et al. | 417/53 |
| 5,586,480 | A | 12/1996 | Gardner | 91/169 |
| 5,647,737 | A | 7/1997 | Gardner et al. | 417/454 |

FOREIGN PATENT DOCUMENTS

| | | | |
|---|---|---|---|
| AU | 137499 | 6/1950 | |
| FR | 1271152 | 7/1961 | |
| GB | 1620 | of 1876 | |
| GB | 1252581 | 11/1971 | F01B/25/10 |
| JP | 5569303 | 5/1980 | |

*Primary Examiner*—Edward K. Look
*Assistant Examiner*—Michael Leslie
(74) *Attorney, Agent, or Firm*—Moore & Van Allen PLLC; Matthew W. Witsil

(57) ABSTRACT

A double acting pneumatic motor having a cylinder, a piston within the cylinder that divides the cylinder into two cavities that vary in volume with movement of the piston, a source of fluid under pressure, and a valve assembly for alternately directing fluid to one cavity while exhausting the other cavity to make the piston reciprocate. The valve assembly resides in a housing, and includes a cylindrical spool that moves axially between two positions with at least one enlarged diameter portion between smaller diameter portions at each end. The pneumatic motor may be provided with a cover for attenuating sound from the exhaust.

23 Claims, 19 Drawing Sheets

PNEUMATIC MOTOR

BACKGROUND

This invention relates generally to pneumatic motors, and more particularly concerns a piston and cylinder device in which a pneumatic valve automatically causes the piston to reciprocate by alternately directing flow of air to and from each side of the piston.

Reciprocating piston and cylinder devices, commonly used as pumps and motors, are generally either single acting or double acting. In single acting piston and cylinder devices, fluid under pressure is selectively directed to only one side of the piston in a forward stroke and means such as a return spring return the piston to its original position. In double acting piston and cylinder devices, fluid under pressure is selectively directed to one side of the piston to drive it in a forward stroke and alternately to the opposite side of the piston to drive it in a return stroke. Usually the control of the pressurized fluid is performed by a main directional valve that alternately directs the fluid to one of two supply passages connected to opposite ends of the cylinder. The side of the piston that is not being pressurized is exhausted to the environment. Air is often the pressurized fluid, and such devices are generally referred to as air motors.

Because single acting piston and cylinder devices rely on mechanical components such as springs and poppet valves actuated by mechanical toggles or trips to function, they are subject to wear. In addition to requiring maintenance, these devices create noise when the toggles are contacted.

Double acting piston and cylinder air motors typically include an air valve assembly within an independent air valve cylinder. The air valve assembly may include a spool-shaped member as the main valve that controls the direction of airflow. At any given time, the spool is positioned towards either one end of the air valve assembly or the other. Two pilot pistons control the position of the spool. Some devices require that the main piston, pilot pistons, or both have differential cross-sectional surface areas in order to create the differential force required to shift the spool. This significantly increases the overall manufacturing cost of the device.

In devices with two identical pilot pistons, the pilot pistons respond to pressurized air flowing through passages originating from pilot ports in the main piston cylinder near the end of the main piston stroke. When the main piston moves past a pilot port to place the pilot port on the high-pressure side of the main piston, a pilot piston will move and shift a corresponding pilot valve. Pilot valves, reciprocally disposed in a through-bore in the spool, selectively vent air chambers at opposite ends of the spool. This results in shifting the spool to direct pressurized air to the opposite side of the main piston, reversing the direction of movement of the main piston.

Conventional double acting devices often malfunction at the cold temperatures incidental to use of compressed gasses. The usual cause of the malfunction is moisture in the air freezing around the spool and the pilot valves. The ice causes the air motor to slow and occasionally stop by clogging passages. Such malfunctioning may occur within five minutes of continuous use. The device cannot be used again until the ice melts. Conventional devices also have airline oil lubrication. This type of lubrication, which is standard industry practice, washes out the grease in the air motor, causing premature failure.

Pneumatically controlled and driven piston and cylinder devices are often used as the motive force for pumping of viscous fluids. For example, such devices are used in manufacturing facilities and commercial automotive maintenance shops to deliver grease, motor oils, gear oils, hydraulic oils, and automatic transmission fluid from original refinery drums or tanks to the location of use.

Noise attenuation is a concern with air motors because the air exhausting at high velocity from the motor can produce excessive sound levels, often in environments such as manufacturing facilities and maintenance shops where workers are in the immediate vicinity on a prolonged basis. Mufflers are the most popular method of noise attenuation. Mufflers are most often canister-type devices that are mounted externally to the air motor. The muffler receives the exhaust air from the motor and expands the air, thereby reducing the air velocity before discharging the air to the environment. One type of muffler design includes an expansion chamber that requires the muffler to be quite large, sometimes as large as the air motor itself, increasing the cost of the air motor. More complex designs include filtering or baffling systems that also increase the cost. Compact mufflers are generally less effective in attenuating noise than is desirable.

Accordingly, there is a need for a pneumatic motor that functions well under a variety of environmental conditions, has durable parts and a long life, is relatively quiet and compact, and is relatively low in cost to manufacture.

SUMMARY

Accordingly, it is an object of the present invention to provide a pneumatic motor that operates reliably for extended periods.

Another object of the present invention is to provide a pneumatic motor that is durable and has low maintenance requirements.

Still another object of the present invention is to provide a pneumatic motor that runs quietly.

A yet further object of the present invention is to provide a pneumatic motor that is compact and relatively inexpensive to manufacture.

According to the present invention, a double acting pneumatic motor is provided that comprises a cylinder, within the cylinder a piston that divides the cylinder into two cavities that vary in volume with movement of the piston, a source of fluid under pressure, and a valve assembly for alternately directing fluid to one cavity while exhausting the other cavity to make the piston reciprocate.

The valve assembly resides in a housing with a cylindrical inside surface, and includes a substantially cylindrical spool, or main valve member, that moves axially between two positions. The housing is in continuous fluid communication with each cavity in the cylinder by way of two passages. The spool alternately directs pressurized air to one passage and exhausts the other passage to the environment, and has a central through-bore that at least a part of which continuously communicates with the pressurized fluid source. The spool has at least one portion with an enlarged diameter in between a smaller diameter portion at each end.

Two variable volume fluid pressure chambers are on opposite sides of the enlarged diameter portion of the spool. A pilot valve substantially within the central bore of the spool also moves axially between two positions that alternately pressurize or exhaust the pressure chambers adjacent to the enlarged diameter portion of the spool. The position of the pilot valve determines the position of the spool, and the position of the spool determines which cavity in the cylinder is pressurized, which cavity is exhausted, and the direction of motion of the piston.

The present invention further comprises a pilot piston at each end of the pilot valve. The pilot pistons are responsive to pressurized air from the cylinder, and cause the pilot valve to shift between its two positions.

A frame within the housing is provided in and around which the spool, pilot valve, and piston valves move. The frame comprises two exhaust adapters and two pilot adapters. The valve assembly parts are exemplarily made of acetal resin.

Also according to the present invention, a pneumatic motor may be provided with a cover for attenuating sound from the exhaust of the pneumatic motor. The cover includes a curved portion that is radially spaced from the curved outer surface of a cylindrical member outside the valve assembly to form an exhaust flow path. The curved portion directs exhaust flow in a substantially tangential direction along the surface of the cylindrical member. The cover may further comprise an expansion chamber and a muffler. Where the cylinder and valve assembly are incorporated into one substantially cylindrical body, the body serves as the curved surface over which exhaust flow is directed. The cover, expansion chamber, and exhaust flow path may all be substantially the same length as the body.

The present invention features a spool and pilot valve that each have two positions, combining to create a four-way valve. The spool, exhaust adapters, pilot adapters, and housing define seven pressure chambers. In one embodiment, two of the chambers are continuously pressurized, three are continuously exhausted, and two are alternately either pressurized or exhausted resulting in a force on the spool that impels the spool to move. Alternatively, in another embodiment, three of the chambers are continuously pressurized, two are continuously exhausted, and two are alternately either pressurized or exhausted resulting in a force on the spool that impels the spool to move. The components of the valve assembly are arranged to create chambers, ports, or passages that direct the flow of pressurized air to and from each side of the piston. Movement of parts changes the available passages in which air can flow by realigning the various passages through the parts and the chambers that are formed by the recessed areas of the parts. The cover improves the diffusion of exhaust and sound attenuation by taking advantage of a phenomenon known as the Coanda effect.

The pneumatic motor has only four moving parts to alternately direct pressurized fluid to the piston chambers. No mechanical levers or springs are required. The piston reciprocates rapidly until the flow of pressurized air is stopped. The pneumatic motor minimizes or eliminates occasions when ice forms around the pilot valve, which can cause the motor to malfunction, such as the main valve stopping between its two positions and allowing air to flow directly from supply to exhaust, with no effect on the piston. Little maintenance is required. The pneumatic motor is also compact and operates relatively quietly.

BRIEF DESCRIPTION OF THE DRAWINGS

For a more complete understanding of this invention reference should now be had to the embodiments illustrated in greater detail in the accompanying drawings and described below.

DETAILED DESCRIPTION

Figure 1:
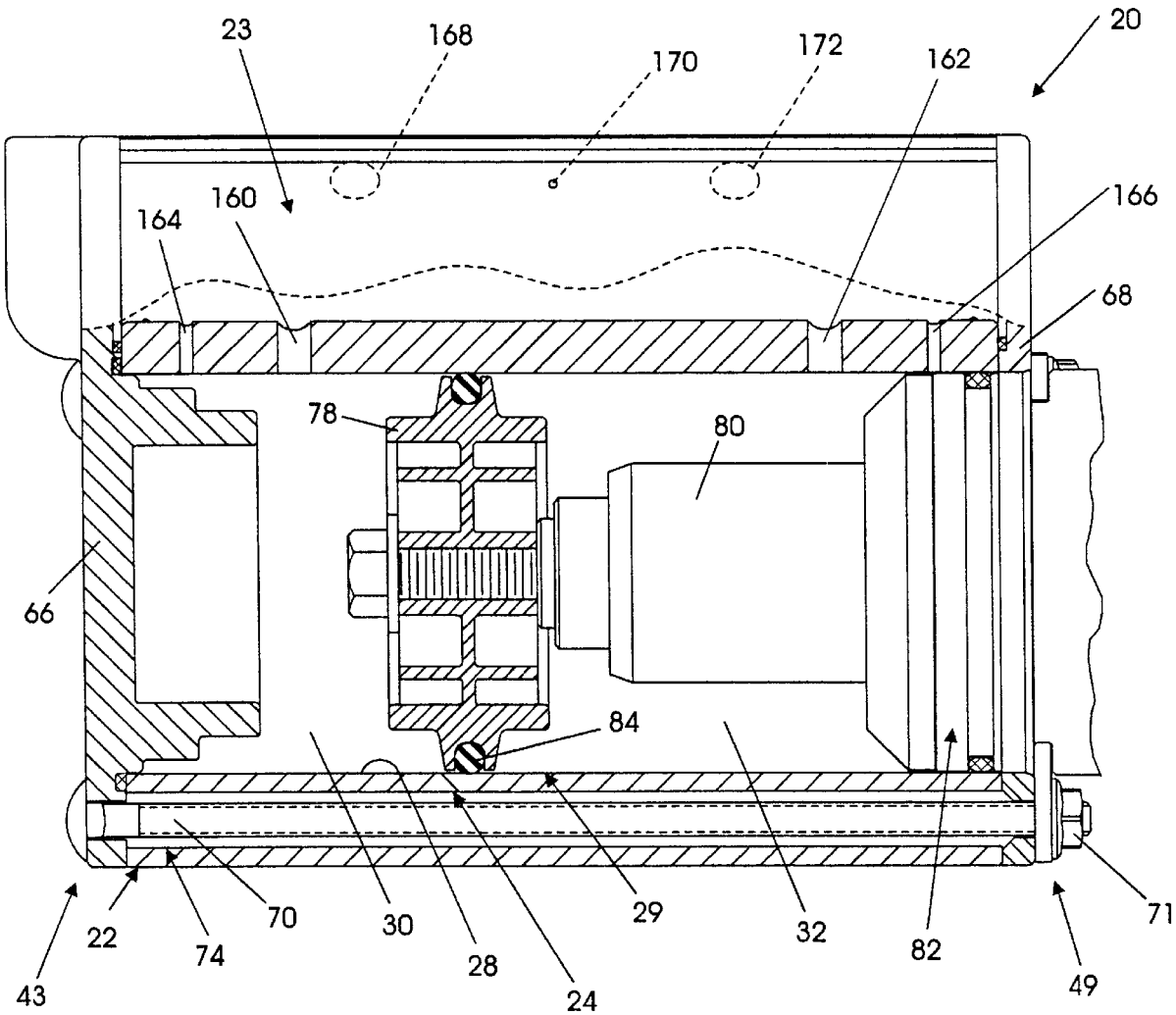
FIG. 1 is a partial longitudinal section view of a pneumatic motor according to the present invention.
Figure 2:
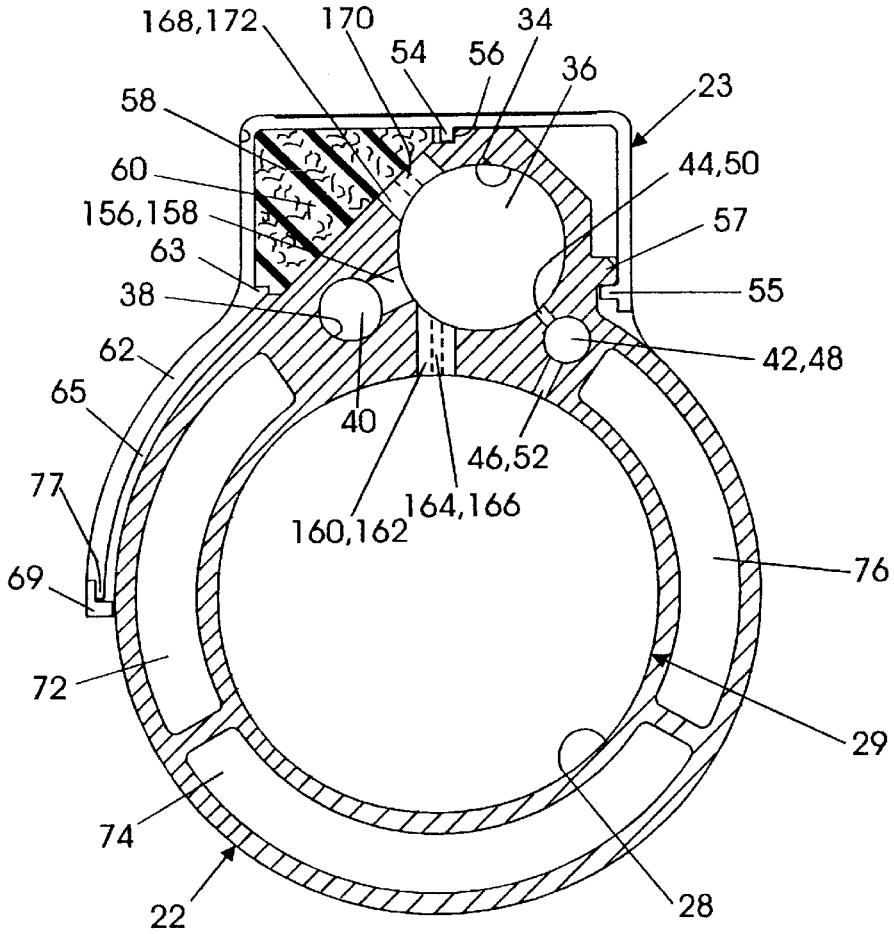
FIG. 2 is a schematic cross-section view of a body, cover, and muffler of the pneumatic motor shown in FIG. 1, as viewed from the left end of FIG. 1.
Figure 5:
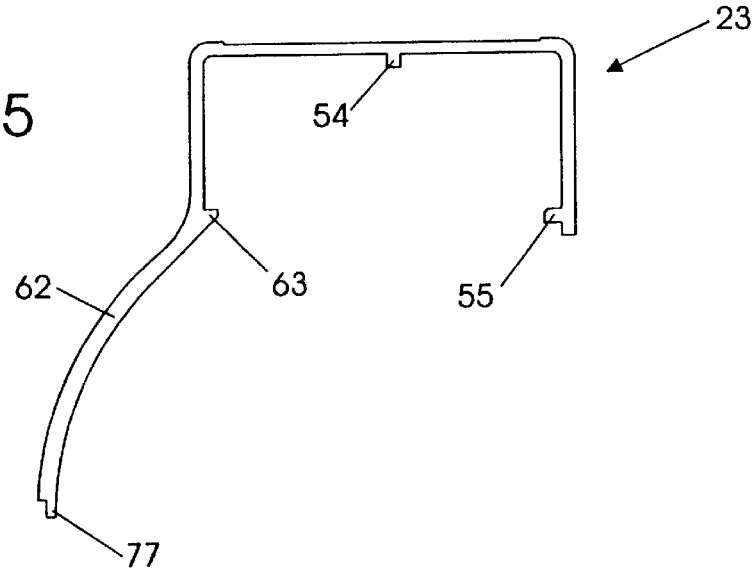
FIG. 5 is a front elevation view of a cover of the pneumatic motor shown in FIG. 1.
Figure 3:
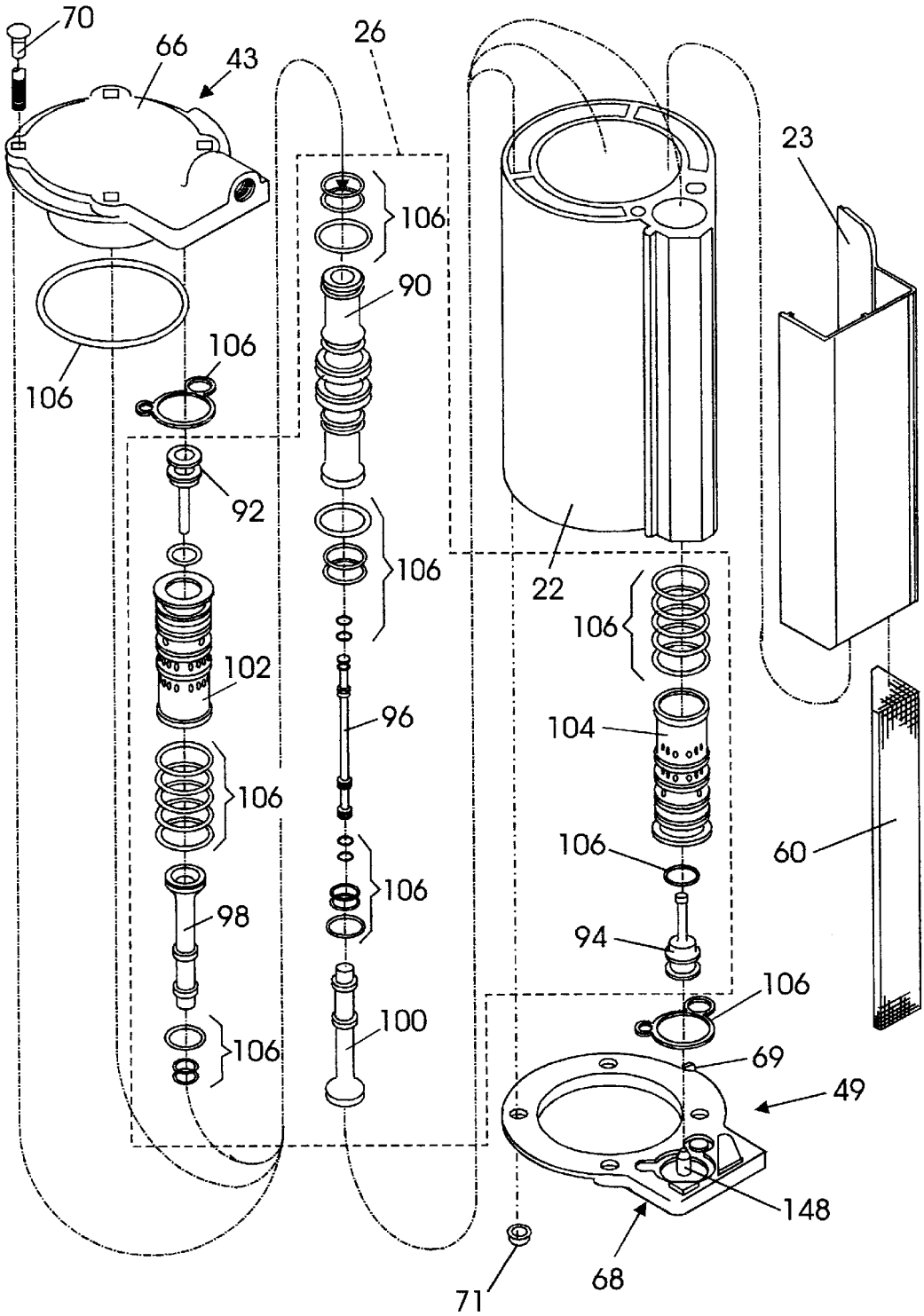
FIG. 3 is an exploded perspective view of a portion of the pneumatic motor shown in FIG. 1.
Figure 4:
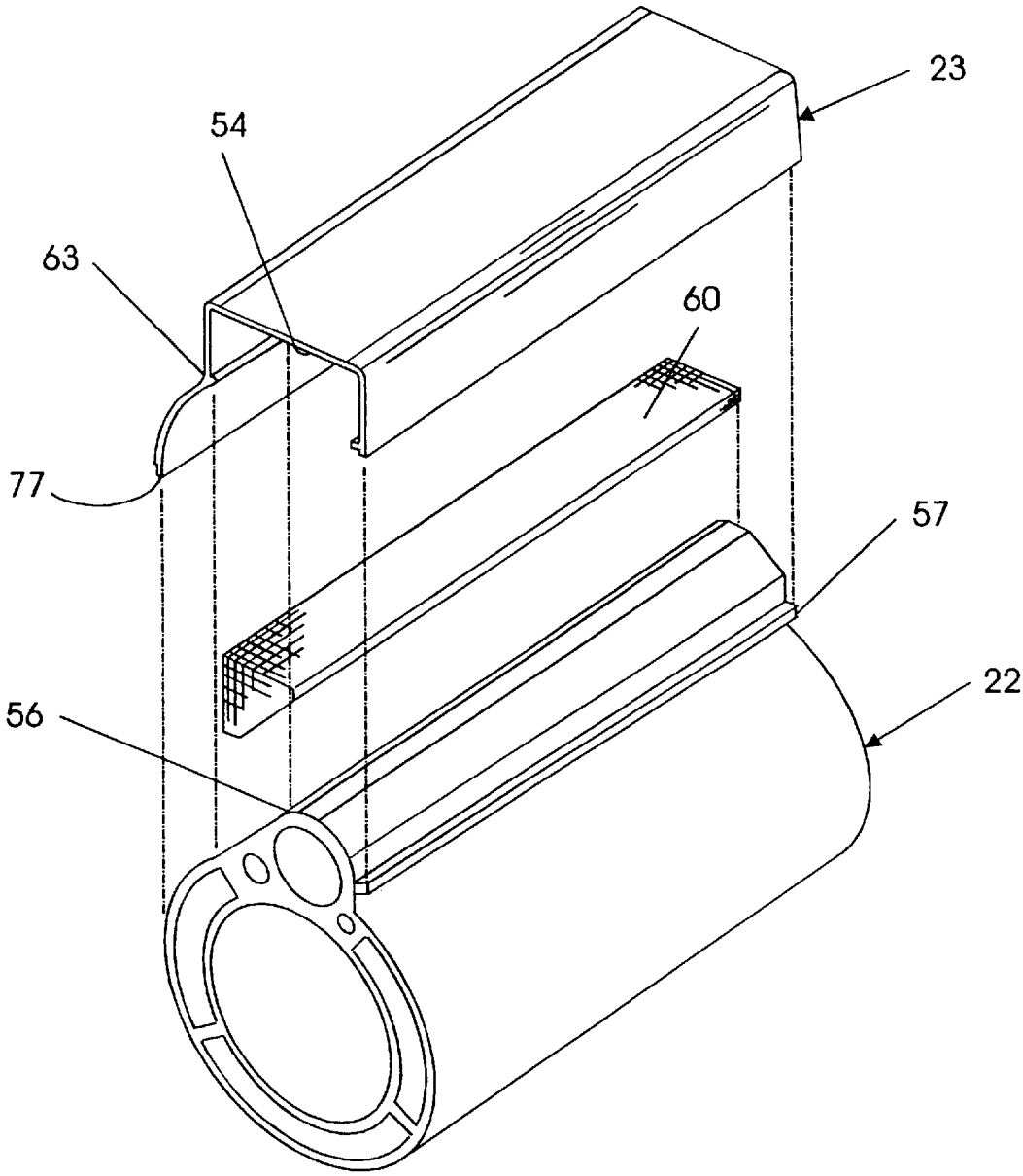
FIG. 4 is an exploded perspective view of a body, muffler, and cover of the pneumatic motor shown in FIG. 1.

Turning now to the drawings, a pneumatic motor referred to as an air motor 20 having features of the present invention is shown in FIG. 1. The air motor 20 comprises a body 22, a cover 23, a piston and cylinder assembly 24, and an air valve assembly 26 (FIG. 3). The air motor body 22 is substantially cylindrical except where it enlarges to include the air valve assembly 26, and has three bores that extend through the full length of the body, shown most clearly in FIG. 2. The largest bore 28 defines a cylindrical void 29 of the piston and cylinder assembly 24. The next largest bore 34 is a cylindrical air valve chamber 36, which houses the air valve 26 components. The smallest through-bore 38 is a cylindrical compressed air conduit 40. In addition, one conduit 42 drilled from the top end 43 of the body 22 connects ports 44 and 46 while another conduit 48 drilled from the bottom end 49 of the body 22 connects ports 50 and 52.

As shown in FIGS. 1 through 5, the cover 23 slides and locks onto the body 22 with a locational clearance fit. The cover 23 has internal protrusions 54, 55 that mate with a slot 56 and a protrusion 57 on the body 22 respectively, forming an expansion chamber 58 for the exhausting air. The cover 23 and expansion chamber 58 extend for the full length of the body 22. The expansion chamber 58 houses a muffler 60 to attenuate exhaust noise. A curved portion 62 of the cover 23 is radially spaced from the outside diameter of the body 22. The remainder of the cover 23 is substantially shaped like three sides of a rectangle. At the intersection of the curved portion 62 with the expansion chamber 58, there is an internal protrusion 63 on the cover 23 that secures the muffler 60 in position. The body 22 and the curved portion 62 of the cover 23 form a curved path 65 for the exhausting air. As the exhaust air exits, the Coanda effect causes it to diffuse around the body 22 resulting in further noise reduction. The Coanda effect is the term given to the observation that a free jet emerging from a nozzle will tend to follow and "attach to" a nearby curved or inclined surface. The jet will come in contact with and flow along the surface if the curvature or angle of inclination is not too sharp. The Coanda effect is further described in U.S. Pat. No. 4,756,230, the contents of which are hereby incorporated by reference.

The curved path 65 causes flow to be generally tangential to the curved surface of the body 22 where the exhaust exits the cover 23. The curved portion 62 may be any length; as measured in degrees around the cylindrical body 22, any length greater than zero degrees will assist in directing the airflow to be tangential to the curved body 22 surface, and will therefor encourage attachment of the exhaust to the body 22 surface to promote the Coanda effect. The desirable length will vary with the curvature of the body 22 surface, but exemplarily the curved portion 62 is about 45 degrees along the cylindrical surface of the body 22.

The top end cap 66 and bottom end cap 68 fit over the respective ends 43, 49 of the body 22 and cover 23. The top end cap 66 is closed, while the bottom end cap 68 has an opening to allow the translation of motion from the piston and cylinder assembly 24. The end caps 66, 68 are fastened in the preferred embodiment with four bolts 70 and associated nuts 71, one pair of which is fully shown in FIG. 1, that pass through chambers 72, 74, and 76. Angle members 69 that hold the curved portion 62 of the cover 23 to the body 22 extend from the end caps 66, 68 and are located only at the ends 43, 49 of the body 22. This results in an opening between the cover 23 and the body 22 that runs the full length of the cover 23 and body 22, rather than individual ports that restrict flow and would therefor be less effective at reducing pressure and attenuating sound. The curved portion 62 of the cover 23 is reduced in thickness at its free end 77 in order to fit in the void created by the angle members 69.

As shown in FIG. 1, the piston and cylinder assembly 24 comprises a piston 78, a rod 80, and a piston guide 82. The piston 78 is reciprocally mounted in the cylinder bore 28 and is attached to the rod 80. The rod 80 is slidably mounted in a through-bore with an annular seal in the guide 82 for the purpose of aligning the rod 80 and the piston 78 for linear reciprocation. The piston 78 has an annular sealing ring 84 that sealingly engages the cylinder bore 28 to divide the cylinder 29 into two distinct variable volume pressure chambers 30, 32. Reciprocating pumping action is produced by first pressurizing a chamber on one side of the piston 78 while simultaneously exhausting the chamber on the opposite side, and then reversing the sides of the piston 78 that are pressurized and exhausted. The reciprocating movement of the piston 78 can cause a pump to which the piston 78 is connected (not shown) to move fluid. While the air motor 20 is a general utility reciprocating piston air motor, one particular application is to drive a material handling reciprocating piston pump.

In general, the body 22, end caps 66, 68, and the components of the piston and cylinder assembly 24 are made of aluminum alloy, such as ANSI 380.0, but as with all the structural elements of the air motor 20, any materials of sufficient strength to withstand the forces encountered in use may be used. The cover 23 is exemplarily made of aluminum alloy 6005-T5. Exemplarily, fasteners such as bolts 70 and other hardware are made of steel, and seals such as the sealing ring 84 are elastomeric. The muffler 60 is made of an open-celled material to allow through-flow of exhaust. The body 22, end caps 66, 68, and the components of the piston and cylinder assembly 24 may be formed by any suitable known process, including but not limited to extrusion, machining, or casting. The scope of the invention, however, is not intended to be limited by the materials or fabrication methods listed herein, but may be carried out using any materials and fabrication methods that allow the construction and operation of the described air motor. The body 22 exemplarily has a length of 6.5-inches, an outside diameter of its cylindrical portion of 4.3-inches, a bore 28 for the piston and cylinder assembly 24 of 3.0-inches, and a bore 34 for the air valve chamber 36 of 1-inch. The dimensions of all of the components of the air motor 20, however, are based on the particular application as may be determined by someone of ordinary skill in the art. A compressed air source supplies pressurized air to the air motor 20, exemplarily in the range of up to 150 pounds per square inch operating pressure.

As shown in FIG. 3, the air valve 26 comprises a spool 90, pilot pistons 92, 94, a pilot valve 96, pilot adapters 98, 100, and exhaust adapters 102, 104. The components are all generally cylindrical, and are shown installed in the air valve chamber 36 in FIG. 6. The spool 90, pilot adapters 98, 100, and exhaust adapters 102, 104 each have axially central through-bores. In selected locations these components have passages or ports through their walls to provide fluid communication between the respective through-bore and the exterior of the component. The pilot adapters 98, 100, exhaust adapters 102, 104, and end caps 66, 68 together with the bore 34 form a stationary frame in and around which the other components move. The moving components of the air valve 26 are the spool 90, pilot pistons 92, 94, and the pilot valve 96, which are constructed to slide along the stationary components. The components of the air valve 26 are arranged to create smaller chambers, ports, or passages that direct the flow of air in order to control the pressure in the pressure chamber 30, 32 on each side of the piston 78. Movement of parts changes the available passages in which air can flow by realigning the various passages through the parts and the chambers that are formed by the recessed areas of the parts. Passages are sized such that the flow of air is not significantly restricted.

As shown in all figures, seals are used in conjunction with the parts to produce nonleaking pressurized chambers. Each component sealingly engages concentric adjacent components. Sealing is accomplished by elastomeric sealing rings 106 (FIG. 3) in the grooves of internal components at lands on each part. The chambers shown on one side of the longitudinal axis of the air valve chamber 36 are the same as the corresponding chamber on the opposite side of the axis. In general, chambers in the figures are substantially annular in shape. For example, in FIG. 6 chamber 86 is the same as chamber 86'; chamber 86 is a generally annular shape. Likewise, chamber 88 is the same chamber as chamber 88'. The remaining chambers are not numbered in this manner, but should be understood to allow fluid communication through their generally annular shapes around the entirety of the air valve chamber 36.

Figure 6:
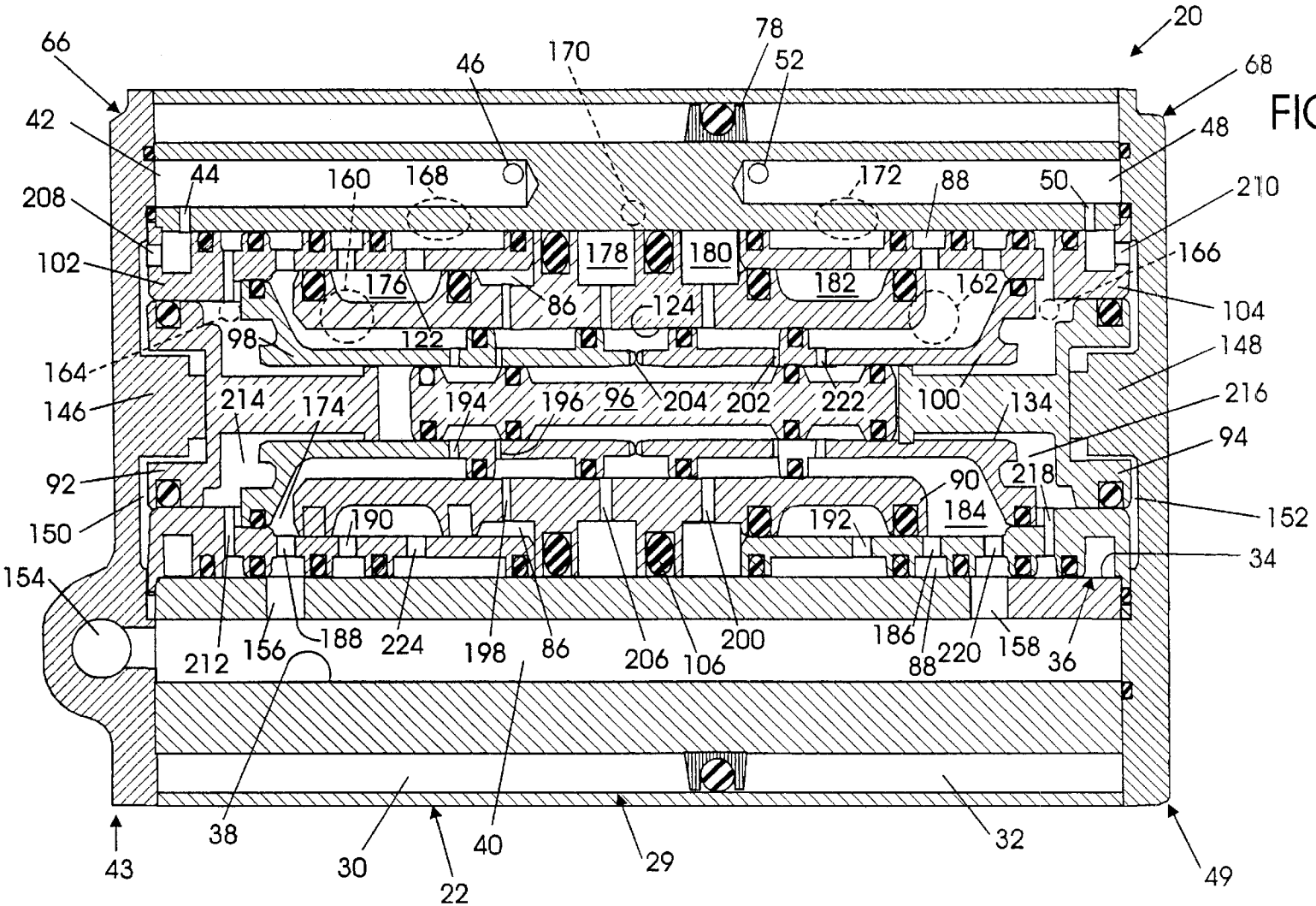
FIG. 6 is a partially schematic longitudinal section view of the pneumatic motor shown in FIG. 1.
Figure 7:
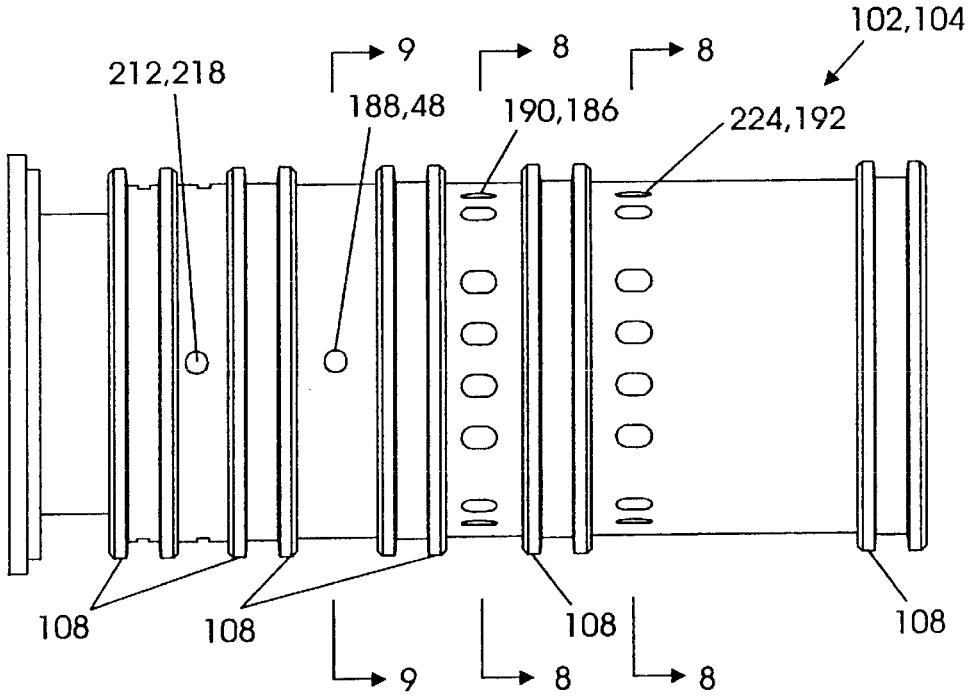
FIG. 7 is a side elevation view of an exhaust adapter of the pneumatic motor shown in FIG. 1.
Figure 8:
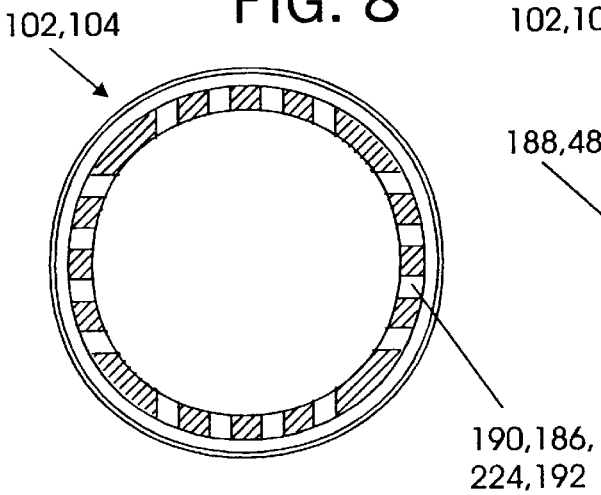
FIG. 8 is a cross-section view of an exhaust adapter taken along line 8—8 of FIG. 7.
Figure 9:
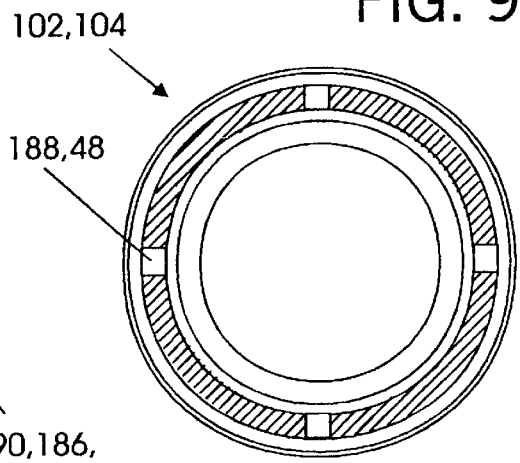
FIG. 9 is a cross-section view of an exhaust adapter taken along line 9—9 of FIG. 7.
Figure 10:
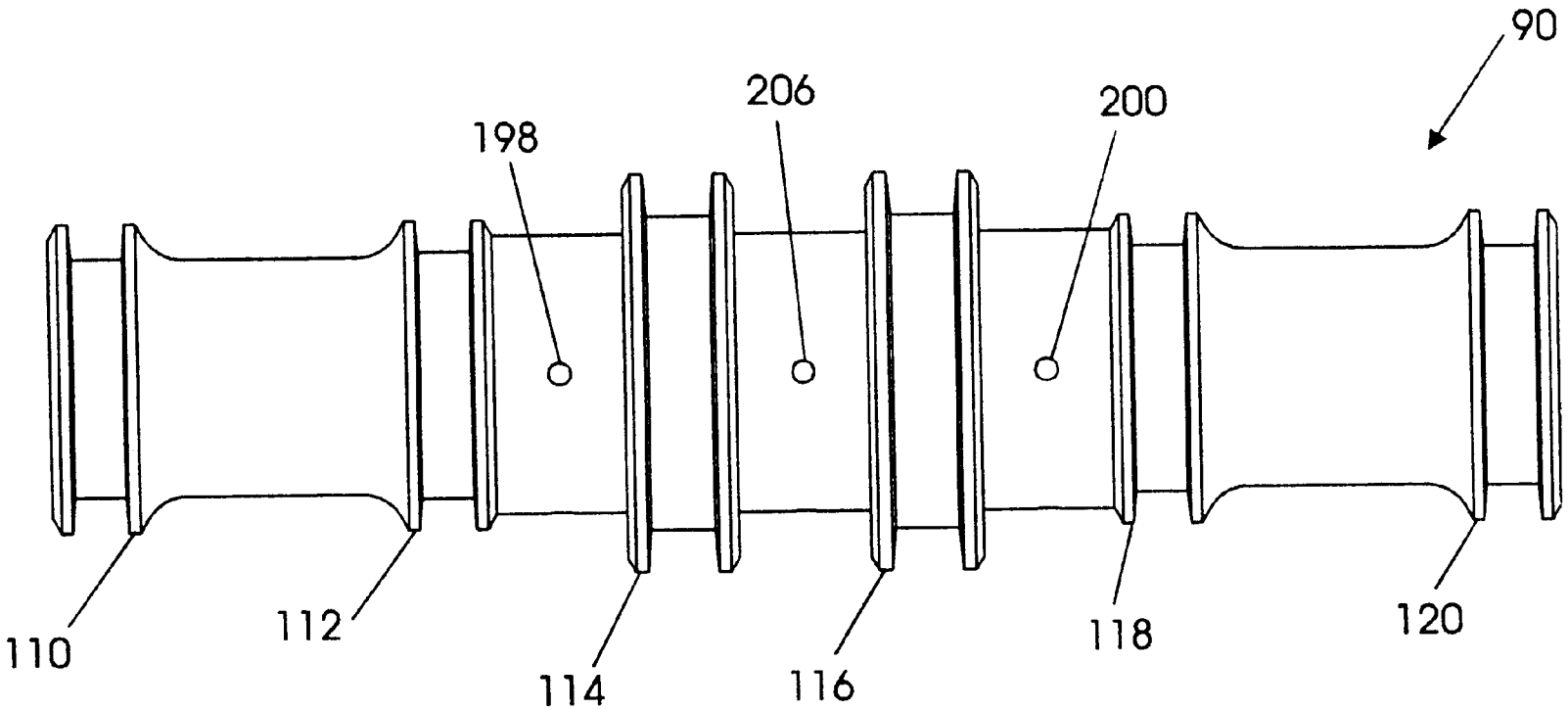
FIG. 10 is a side elevation view of a spool of the pneumatic motor shown in FIG. 1.
Figure 11:
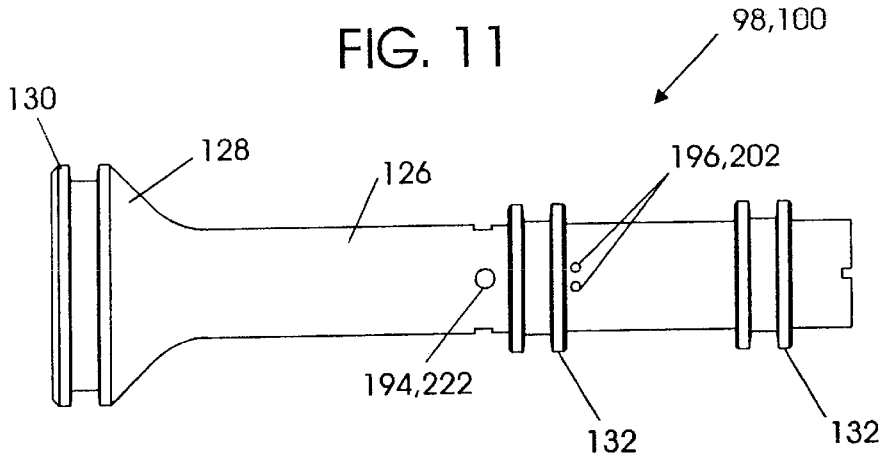
FIG. 11 is a side elevation view of a pilot adapter of the pneumatic motor shown in FIG. 1.

The exhaust adapters 102, 104 sealingly and fixedly engage the air valve bore 34 with O-ring seals at lands 108 (FIGS. 7, 8, and 9). The spool 90 is the main valve member and controls the direction of airflow to and from each piston chamber 30, 32. The spool 90 includes seals at lands 110, 112, 114, 116, 118, 120 (FIG. 10). The diameter of the spool 90 increases at the two lands 114, 116 on the longitudinally central portion of the spool 90, and the seals at these lands 114, 116 slide along the cylindrical walls of the air valve bore 34. The central through-bores of the air valve 26 components are shown in FIG. 6. At each end of the spool 90 the diameter is reduced and seals at lands 110, 112, 118, 120 on the spool 90 each slide within the central through-bores 122 of the respective exhaust adapters 102, 104. The central through-bore 124 of the spool 90 receives the stem portion 126 (FIG. 11) of the pilot adapters 98, 100 at each end of the air valve chamber 36. The pilot adapters 98, 100 widen at one end 128 where they fixedly engage the exhaust adapters 102, 104 at land 130. The seals at lands 132 on the stem portion of the pilot adapters 98, 100 sealingly engage the through-bore 124 of the spool 90, and allow the spool 90 to slide along the lands 132.

Figure 12:
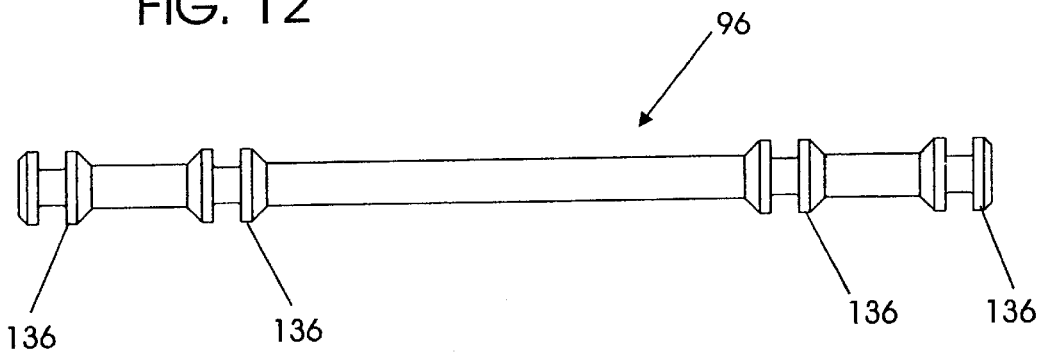
FIG. 12 is a side elevation view of a pilot valve of the pneumatic motor shown in FIG. 1.
Figure 13:
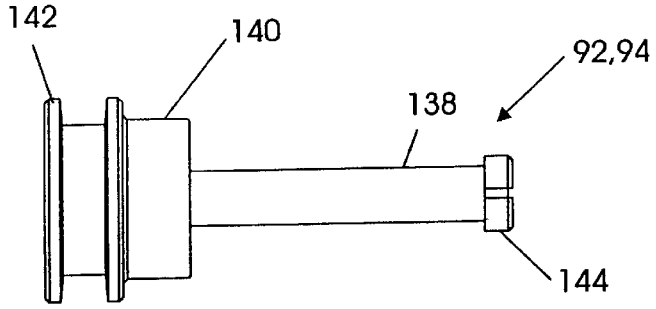
FIG. 13 is a side elevation view of a pilot piston of the pneumatic motor shown in FIG. 1.

The pilot valve 96 (FIG. 12), including lands 136, is reciprocally and slidably mounted to the through-bore 134 of the pilot adapters 98, 100. The pilot pistons 92, 94 (FIG. 13) have a stem portion 138 coaxial with and located adjacent to each end of the pilot valve 96 extending from the bottom of a cylindrical portion 140. The enlarged cylindrical portion 140 of each pilot piston 92, 94 is hollow and has an open end facing toward the respective end of the air valve chamber 36, and has a land 142 that sealingly and slidably engages the respective exhaust adapter 102, 104. A slightly enlarged diameter at the opposing end of the pilot pistons 92, 94 serves as a guide 144 to center the pilot pistons 92, 94 within the through-bore 134 of the respective pilot adapter 98, 100.

The air valve 26 components are exemplarily made of an acetal resin, such as Delrin® 570 (Delrin is a registered trademark of E.I. du Pont de Nemours and Company), but as with all the structural elements of the air motor 20, any materials of sufficient strength to withstand the forces encountered in use may be used. Desirable characteristics of acetal resins include: high tensile strength, impact resistance, and stiffness; good fatigue endurance; resistance to moisture and solvents; and natural lubricity.

As shown in FIG. 6, the top end cap 66 and the bottom end cap 68 each have a protuberance 146, 148 that is loosely received within the respective pilot piston 92, 94. The fit is such that the end of the pilot piston 92, 94 will not contact the respective end cap 66, 68, and therefore a chamber 150 exists even when the pilot piston 92 is in the extreme top position, and a chamber 152 exists when pilot piston 94 is in the extreme bottom position.

The air valve chamber 36 has a main supply port 154 to which a source of pressurized fluid, such as compressed air, may be connected. The main supply port 154 is connected to the compressed air conduit 40, which communicates through passages 156 and 158 with the air valve chamber 36. The air valve chamber 36 communicates with the piston pressure chambers 30, 32 through main passages 160, 162 and reset passages 164, 166. The air valve chamber 36 also communicates through pilot passages 46, 52 with the pressure chambers 30, 32 through conduits 42, 48 and then passages 44, 50 respectively. The air valve chamber 36 vents to the environment through passages 168, 170, 172 and the expansion chamber 58 defined by the cover 23 (FIG. 2).

The spool 90 defines seven chambers 174, 176, 86, 178, 180, 182, 184 with the pilot adapters 98, 100 and the exhaust adapters 102, 104. Passages 156 and 158 continuously pressurize, or direct fluid, to chambers 174 and 184 respectively. Chambers 176, 178, and 182 are continuously exhausted by passages 168, 170, and 172 respectively. Chambers 86 and 180 are alternately pressurized or exhausted.

The spool 90 and the pilot valve 96 each have two positions and combine to create a four-way valve. The position of the spool 90 determines which chamber 30, 32 within the piston cylinder 29 is pressurized and which is exhausted. The position of the pilot valve 96 determines which chamber 86, 180 is pressurized or exhausted, and this in turn determines the position of the spool 90 based on a differential force on each end of the spool 90. Pressurized fluid within these chambers 86, 180 exerts a force on the longitudinally central portion of the spool 90 with the increased diameter at the lands 114, 116 that causes the spool 90 to try move to the end of the air motor 20 that is opposite the force.

Figure 14A:
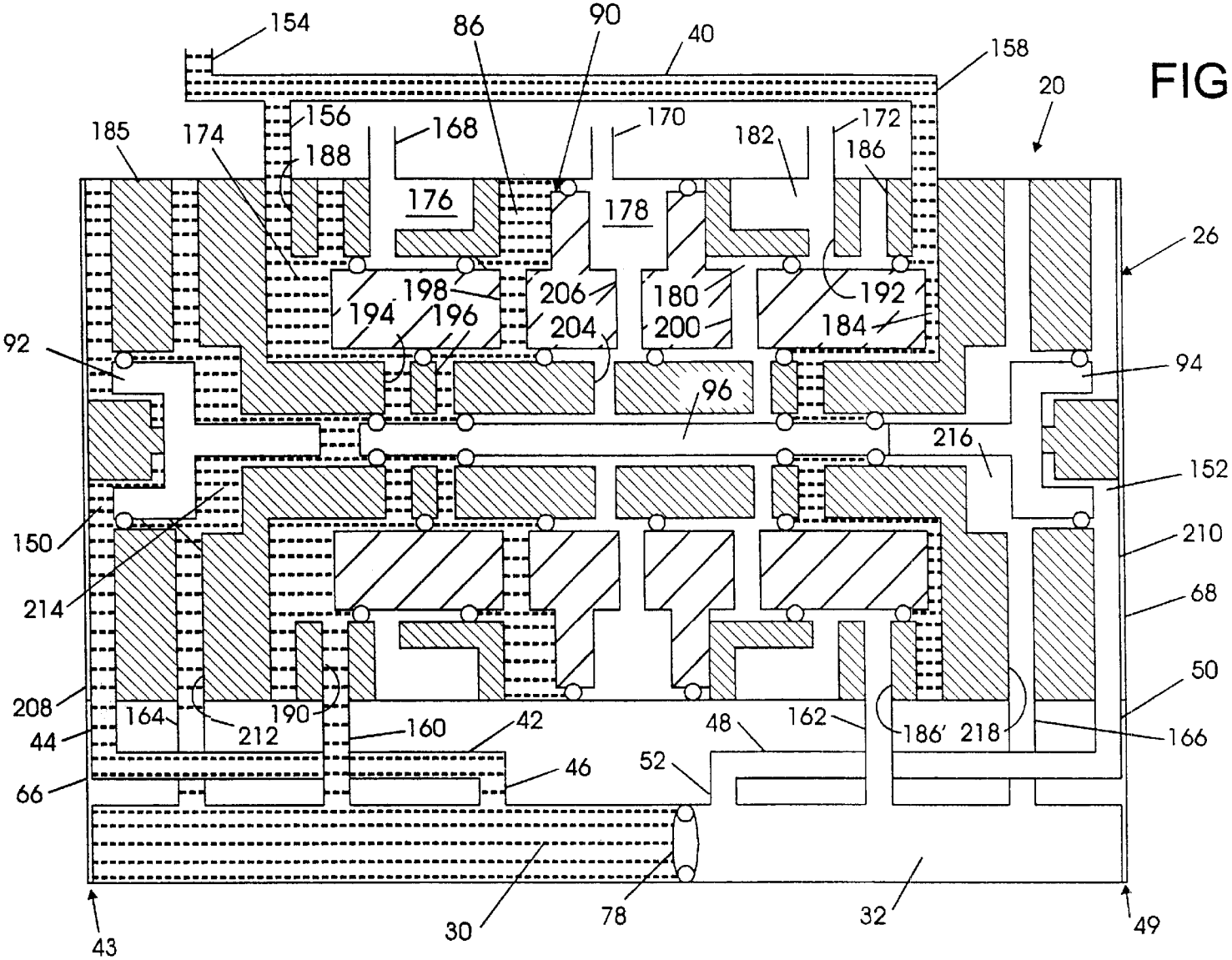
FIGS. 14A–14D are schematic views showing a sequence of operation of the pneumatic motor shown in FIG. 1.

FIGS. 14A–14D show how the air motor 20 operates. FIG. 14A shows an initial position in the sequence of operation. Compressed air, being air supplied to the air valve 26, and exhaust air, being air leaving the air valve 26, will be hereafter referred to as "air" and "exhaust" respectively. For simplicity, some chambers on the perimeter of the air valve 26 are not shown in FIGS. 14A–14D. For example, chamber 88 (FIG. 6) which connects to passage 186 is not shown in FIG. 14A. It should be understood, however, that corresponding passages on opposite sides of the longitudinal axis of the air valve 26 are in fluid communication through the generally annular chambers that are not shown. For example, in FIG. 14A passage 186 is in fluid communication with passage 186', even though the chamber 88 that provides this fluid communication is not shown here. As previously noted, the moving parts 90, 92, 94, 96 move in and around a stationary frame 185 formed by the pilot adapters 98, 100, exhaust adapters 102, 104, and end caps 66, 68.

As shown in FIG. 14A, air enters the air motor 20 through main supply port 154. Air is routed via passage 156, passage 188, chamber 174, passage 190, and passage 160 to pressurize chamber 30. Simultaneously, chamber 32 exhausts via passages 162, 186, 192, chamber 182, and passage 172 to atmosphere. The pressure in chamber 30 is therefore higher than that in chamber 32. This net pressure differential moves the piston 78 down towards the bottom 49 of the air motor 20. Air also communicates via passage 156, passage 188, chamber 174, and passages 194, 196, and 198 to chamber 86. Simultaneously, chamber 180 exhausts via passages 200, 202, 204, and 206, chamber 178, and passage 170 to atmosphere. Because chambers 174 and 86 are pressurized on the top end of the spool 90 and chamber 184 is the only chamber pressurized on the bottom end of the spool, there is a net downward force on the spool, causing the spool to remain in the position toward the bottom 49 of the air motor 20.

Pilot air from chamber 30 communicates via passages 46, 42, 44, and 208 to pressurize pilot chamber 150. Pilot air from chamber 30 also communicates via passages 164 and 212 to pressurize chamber 214. Pilot piston 92 therefore does not move because there is equal pressure on both sides of the piston. Simultaneously, chambers 152 and 216 both exhaust into chamber 32. Chamber 152 exhausts via passages 210, 50, 48, and 52, while chamber 216 exhausts via passages 218 and 166. Therefore, pilot piston 94 has no net force on it, and also does not move.

Figure 14B:
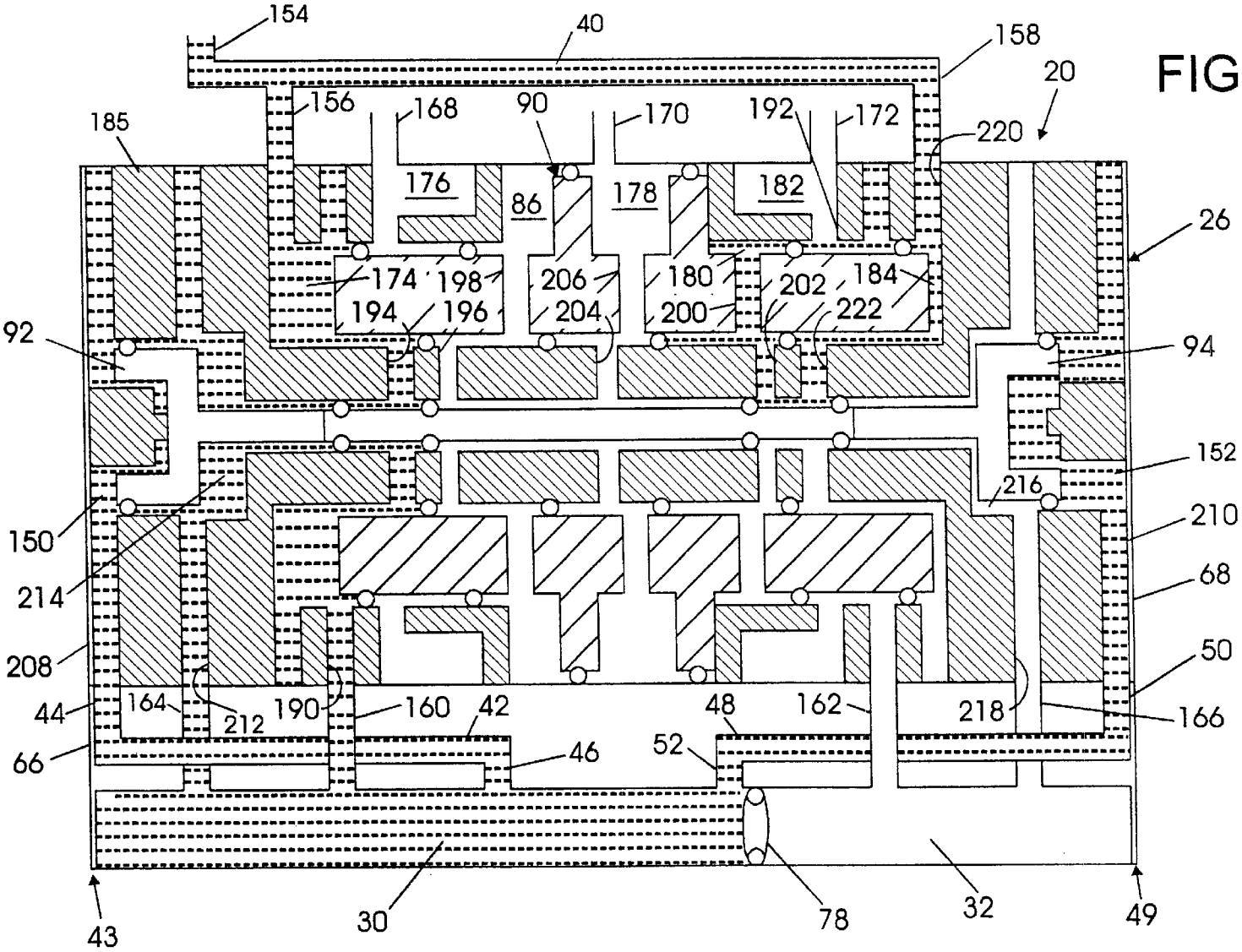

FIG. 14B shows the piston 78 after having moved down towards the bottom 49 of the air motor 20, and having moved across passage 52. Immediately after the piston 78 crosses passage 52, air communicates via passages 52, 48, 50, and 210 to pressurize chamber 152, causing pilot piston 94 to push the pilot valve 96 up towards the top 43 of the air motor 20. Since the upper pilot piston 92 is pressurized on both sides in chambers 150 and 214, there is no resistance to that pilot piston moving towards the top 43. Air is then routed via passage 158, passage 220, chamber 184, and passages 222, 202, and 200 to pressurize chamber 180 while chamber 86 simultaneously exhausts via passages 198, 196, 204, 206, chamber 178, and passage 170 to atmosphere. With chambers 180 and 184 pressurized on the bottom side of the spool 90 and only chamber 174 pressurized on the top side of the spool, the upward force on the spool is greater than the downward force.

Figure 14C:
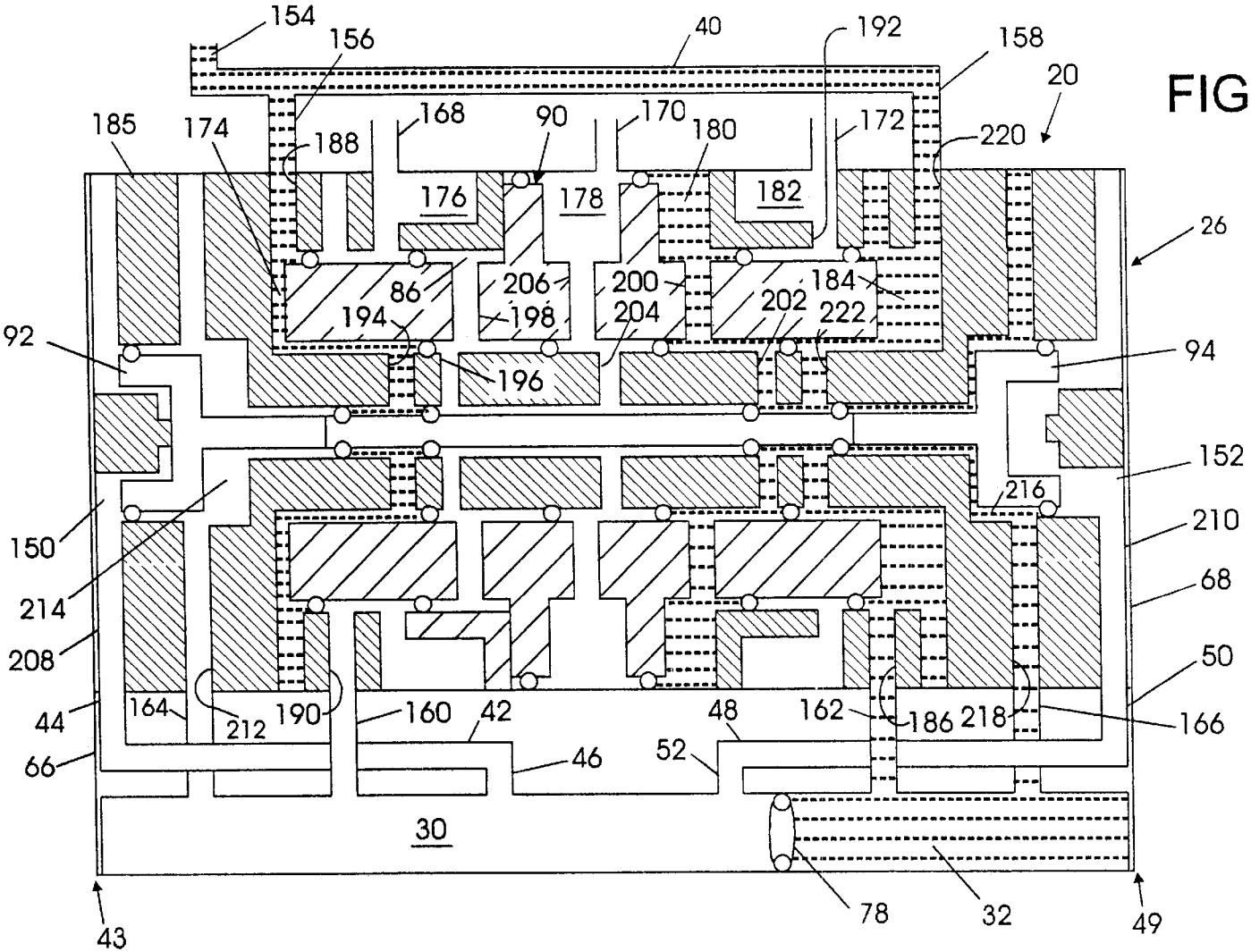

FIG. 14C shows that the overall upward force causes the spool 90 to move up toward the top 43 of the air motor 20 and reroute air via passage 158, passage 220, chamber 184, and passages 186 and 162 to pressurize the chamber 32 while simultaneously exhausting chamber 30 via passages 160, 190, 224, chamber 176 and passage 168 to atmosphere. The differential pressure on the piston 78 resulting from the chamber 32 being at a greater pressure than the chamber 30 causes the piston to change direction and move upward toward the top 43 of the air motor 20. Chamber 150 now exhausts to atmosphere via passages 208, 44, 42, 46, and chamber 30, which exhausts to atmosphere as described above. Chamber 214 also exhausts to atmosphere via passages 212, 164 and chamber 30, while chamber 152 exhausts to atmosphere via passages 210, 50, 48, 52, and chamber 30. Chamber 216 is pressurized by air from chamber 32 that communicates via passages 166 and 218.

Figure 14D:
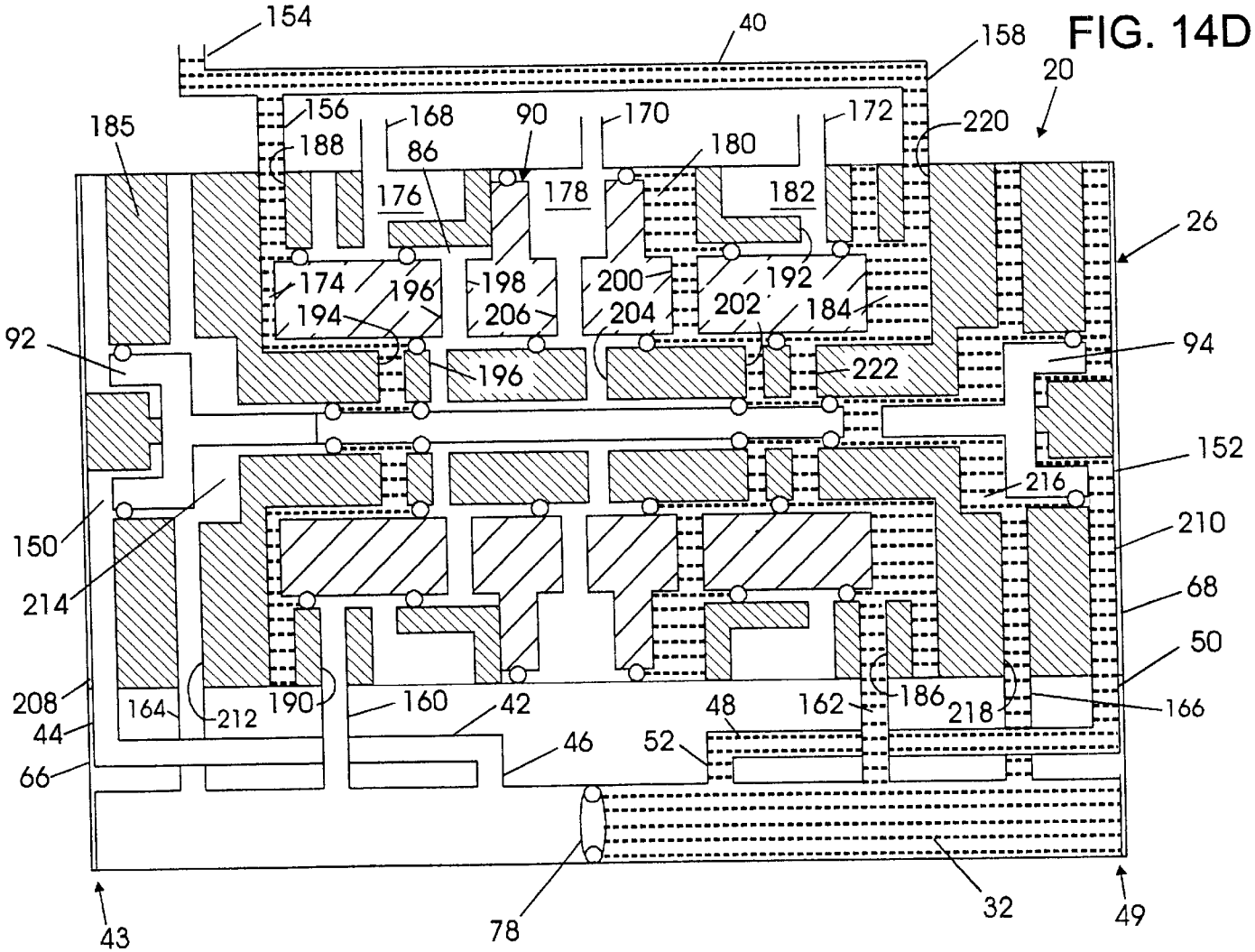

FIG. 14D shows that the pilot piston 94, under the differential pressure resulting from a pressurized chamber 216 and an exhausted 152 in FIG. 14C, next moves down toward the bottom 49 of the air motor 20. Immediately after the piston 78 crosses passage 52, air communicates with chamber 152 via passages 52, 48, 50, and 210 and pilot piston 94 becomes pressurized on both sides. The piston 78 continues to move up toward the top 43 of the air motor past passage 46 and then returns to the center of the air motor 20, experiencing a sequence similar to that described above, completing a cycle. The piston 78 moves in a rapid reciprocating manner until the supply of air is terminated.

Figure 15:
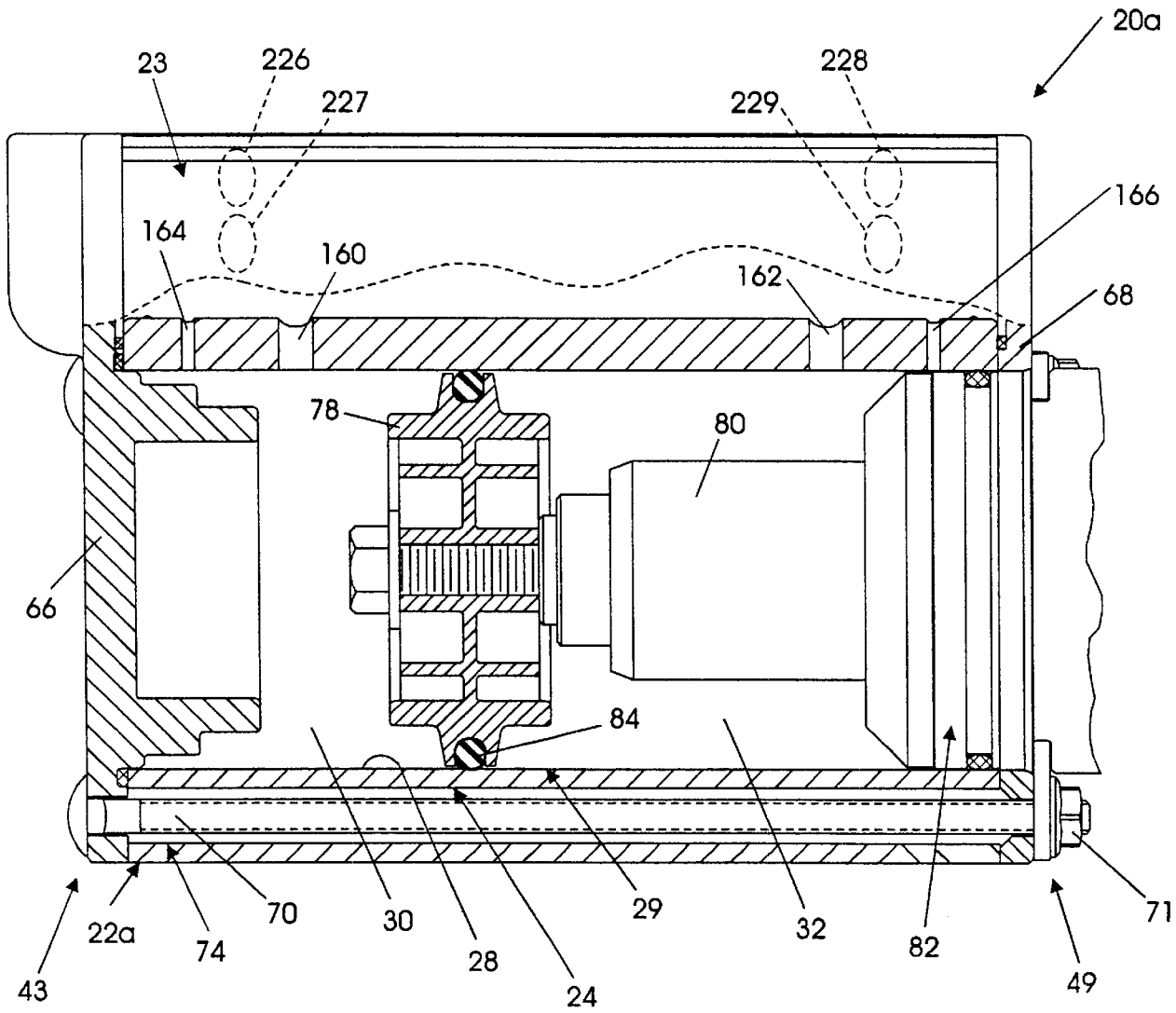
FIG. 15 is a partial longitudinal section view of another embodiment of a pneumatic motor according to the present invention.
Figure 16:
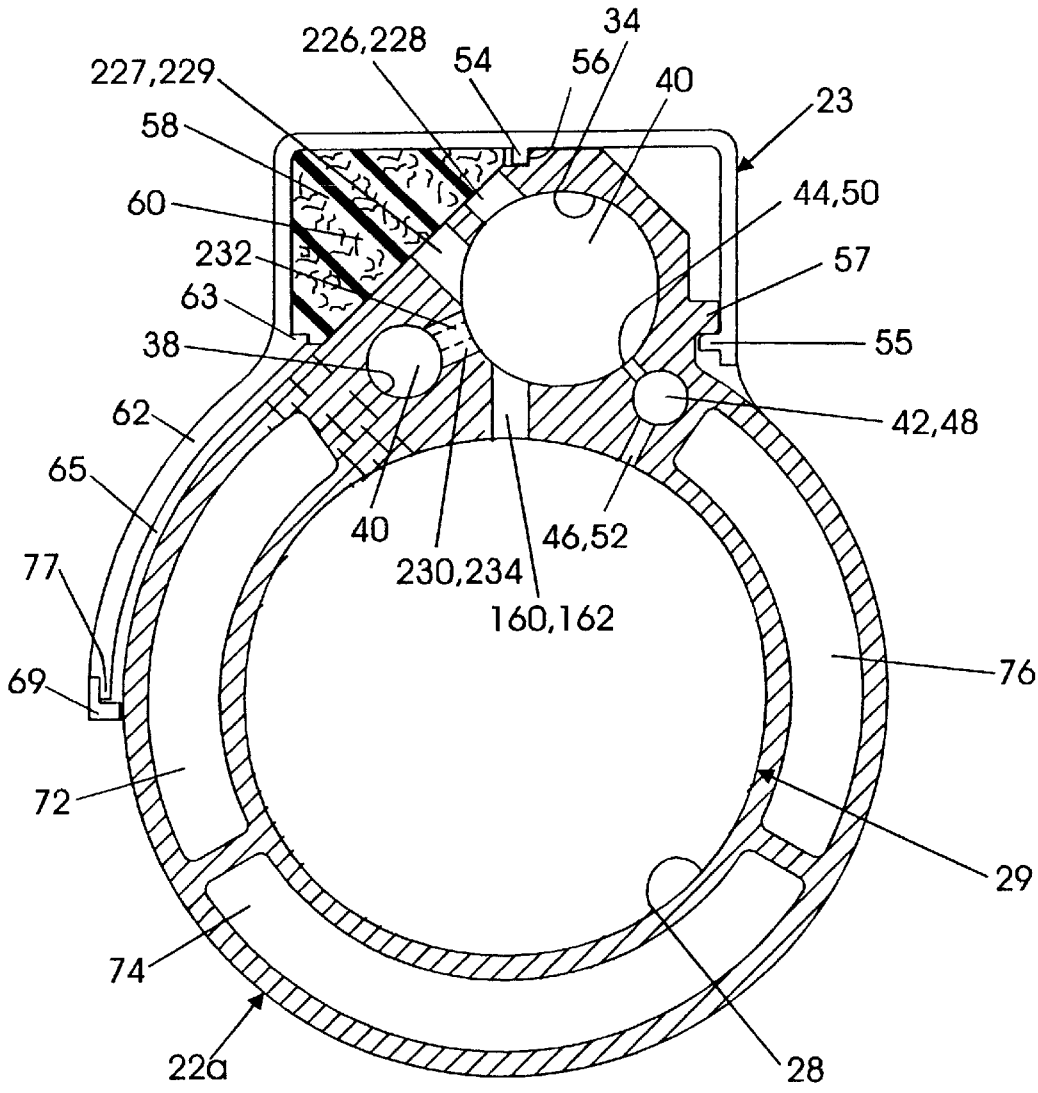
FIG. 16 is a schematic cross-section view of a body, cover, and muffler of the pneumatic motor shown in FIG. 15, as viewed from the left end of FIG. 15.
Figure 17:
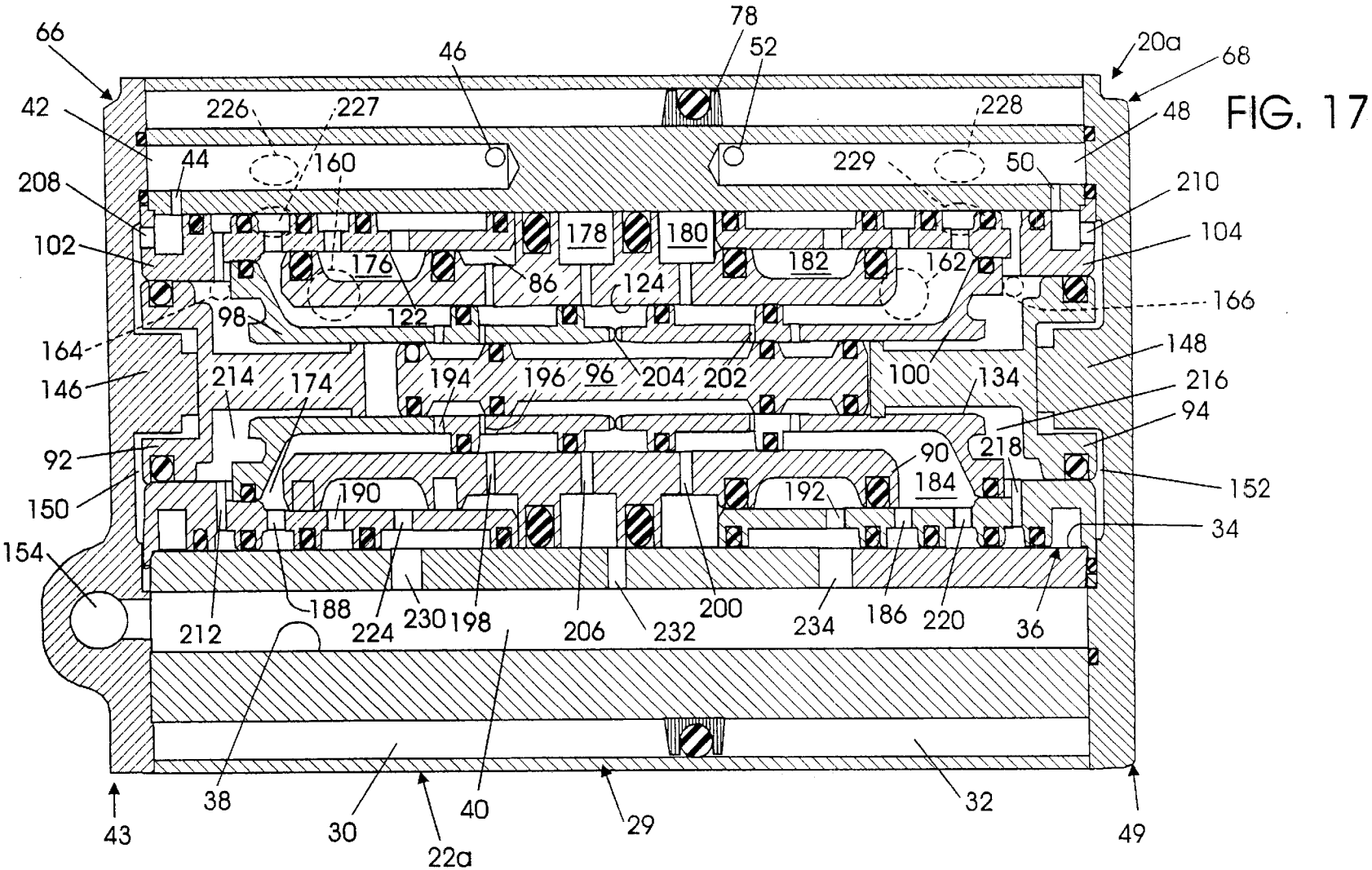
FIG. 17 is a partially schematic longitudinal section view of the pneumatic motor shown in FIG. 15.

The best mode embodiment of an air motor 20*a* according to the present invention is shown in FIGS. 14, 15, and 16. Where a feature designated with a number is modified between figures, a letter is added after the feature number to distinguish that feature from a similar feature in a previous figure.

Although the previously described air motor 20 improves on the performance of known designs, during prolonged use, moisture in the exhausting air may still freeze and ice may form around the pilot valve 96, mixing with grease in the air valve 26. Although the air motor 20 continues to function, the ice can abrade the sealing rings 106 on the pilot valve 96, shortening their life. By reversing the path of the compressed air into the air valve 26 such that the air inlet becomes the exhaust and air outlet becomes the air supply, the annular void defined by the central portions of the bore 124 of the spool 90 and the pilot valve 96 are continuously pressurized. This deters ice accumulation and eliminates abrasion of the sealing rings 106, extending the life of the air motor 20*a* yet further.

To reverse the air path within the air valve 26, air inlet passages 156 and 158 in the air motor body 22 are replaced by passages 230 and 234 that are located between passages 160 and 162, while exhaust passages 168 and 172 are replaced by passages 226, 227, 228, and 229 that are located to the outside of passages 160 and 162. The pilot exhaust passage 170 is replaced by passage 232 that is located between passages 230 and 234 such that passage 232 becomes an air inlet instead. The modified body 22*a* results.

Similarly to FIGS. 6 and 14A–14D, in FIGS. 17 and 18A–18D the chambers on one side of the longitudinal axis of the air valve 26 are the same as the corresponding chambers on the opposite side of the axis. As in FIGS. 14A–14D, in FIGS. 18A–18D some of the chambers on the perimeter of the air valve 26 are not shown, but it should be understood that corresponding passages on opposite sides of the axis are in fluid communication because of the generally annular chambers that exist throughout the air valve chamber 36.

As shown in FIGS. 17 and 18A–18D, again similarly to FIGS. 6 and 14A–14D, the spool 90 defines seven chambers 174, 176, 86, 178, 180, 182, 184 with the pilot adapters 98, 100 and the exhaust adapters 102, 104. The compressed air conduits and the exhaust passages, however, have been reversed. Passages 226, 227, 228, and 229 continuously exhaust chambers 174 and 184 respectively. Chambers 176, 178, and 182 are continuously pressurized, or in other words have fluid directed to them, by passages 230, 232, and 234 respectively. Chambers 86 and 180 are alternately pressurized or exhausted.

Figure 18A:
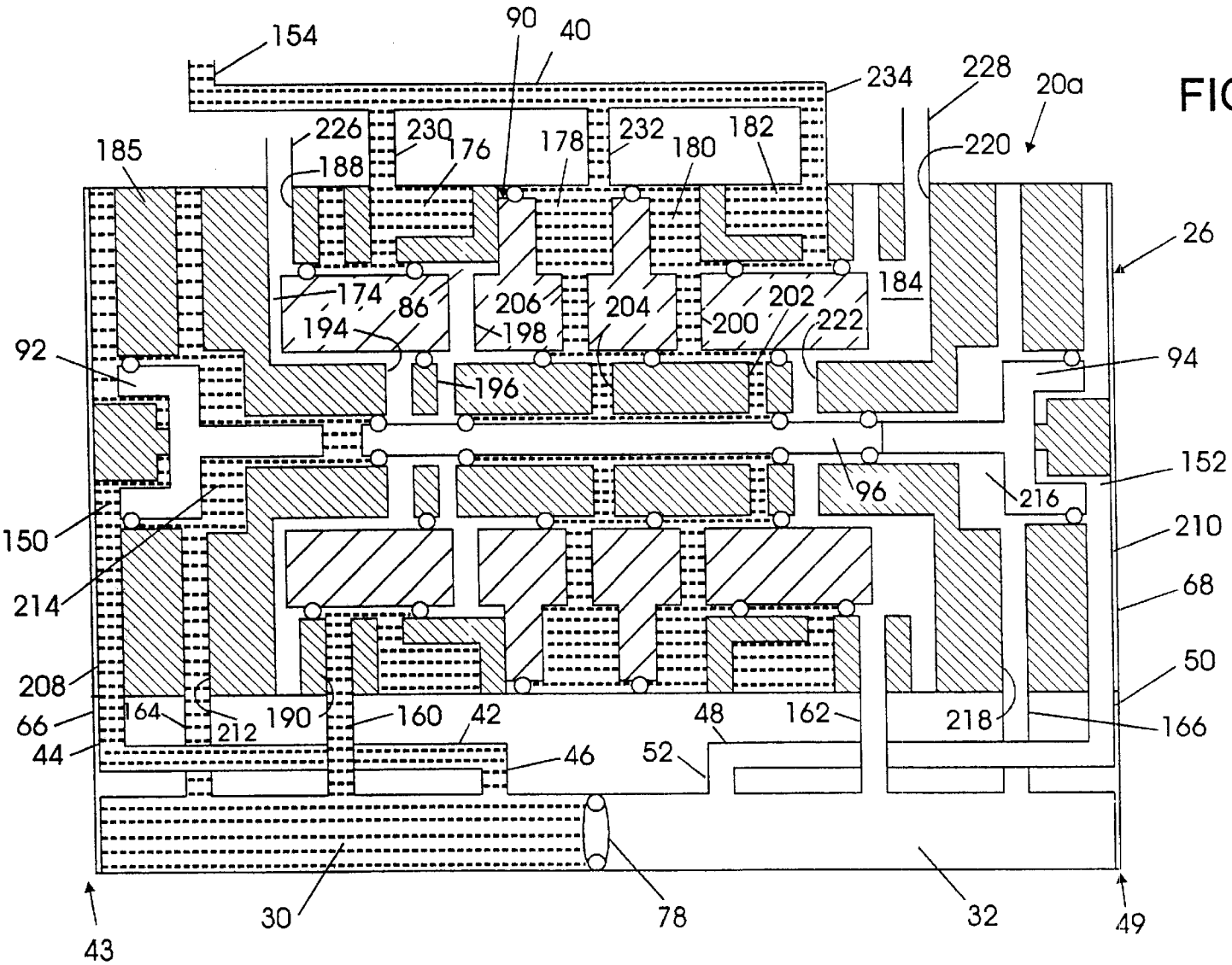
FIGS. 18A–18D are schematic views showing a sequence of operation of the pneumatic motor shown in FIG. 15.

FIG. 18A shows the initial position in a sequence of operation of the air motor 20*a*. As shown in FIG. 18A, air enters the air motor 20*a* through main supply port 154. Air is routed via passage 230, chamber 176, and passages 236, 190 and 160 to pressurize chamber 30. Simultaneously, chamber 32 exhausts via passage 162, passage 186, chamber 184, and passages 220 and 228 to atmosphere. The pressure in chamber 30 is therefore higher than that in chamber 32. This net pressure differential moves the piston 78 down, or towards the bottom 49 of the air motor 20*a*. Air also communicates via passage 232, chamber 178, and passages 206, 204, 202, and 200 to pressurize chamber 180. Simultaneously, chamber 86 exhausts via passages 198, 196, 194, chamber 174, and passages 188 and 226 to atmosphere. Because chamber 180 is the only chamber pressurized that exerts a net axial force on the spool 90 and is on the bottom end of the spool, there is a net upward force on the spool, causing the spool to remain in the position toward the top end 43.

Pilot air from chamber 30 communicates via passages 46, 42, 44, and 208 to pressurize chamber 150. Pilot air from chamber 30 also communicates via passages 164 and 212 to pressurize chamber 214. The pilot piston 92 therefore does not move because there is equal pressure on both sides of the pilot piston 92. Simultaneously, chambers 152 and 216 both exhaust into chamber 32. Chamber 152 exhausts via passages 210, 50, 48, and 52, while chamber 216 exhausts via passages 218 and 166. Therefore, the pilot piston 94 has no net force on it, and also does not move.

Figure 18B:
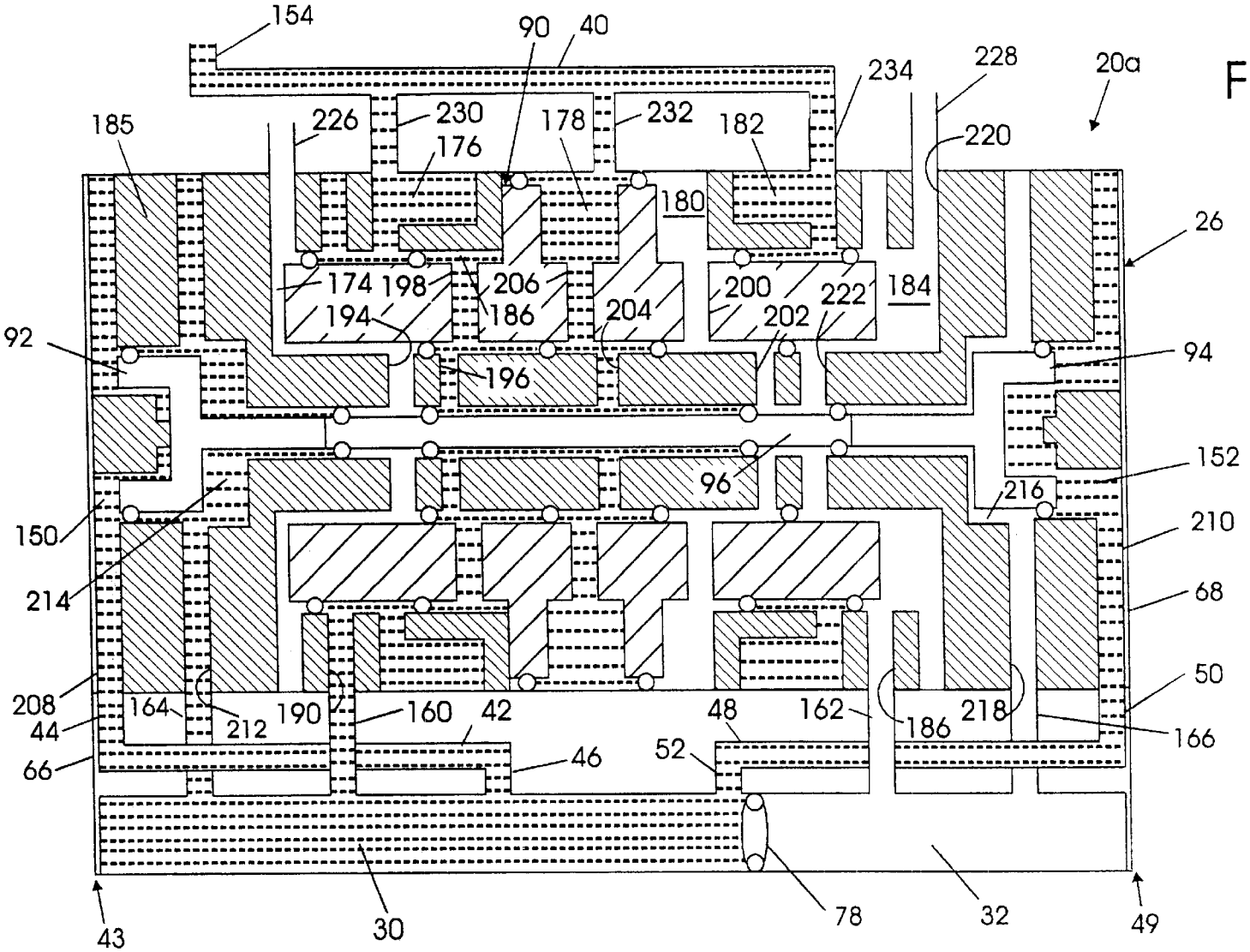

FIG. 18B shows the piston 78 after having moved down towards the bottom 49 of the air motor 20*a*, and having moved across passage 52. Immediately after the piston 78 crosses passage 52, air communicates via passages 52, 48, 50, and 210 to pressurize chamber 152 causing the pilot piston 94 to push the pilot valve 96 up toward the top end 43. Air through passage 232 is then routed via chamber 178 and passages 206, 204, 196, and 198 to pressurize chamber 86 while chamber 180 simultaneously exhausts via passages 200, 202, 222, chamber 184 and passages 220 and 228 to atmosphere. Only the pressurized air in chamber 86 exerts a net axial force on the spool 90.

Figure 18C:
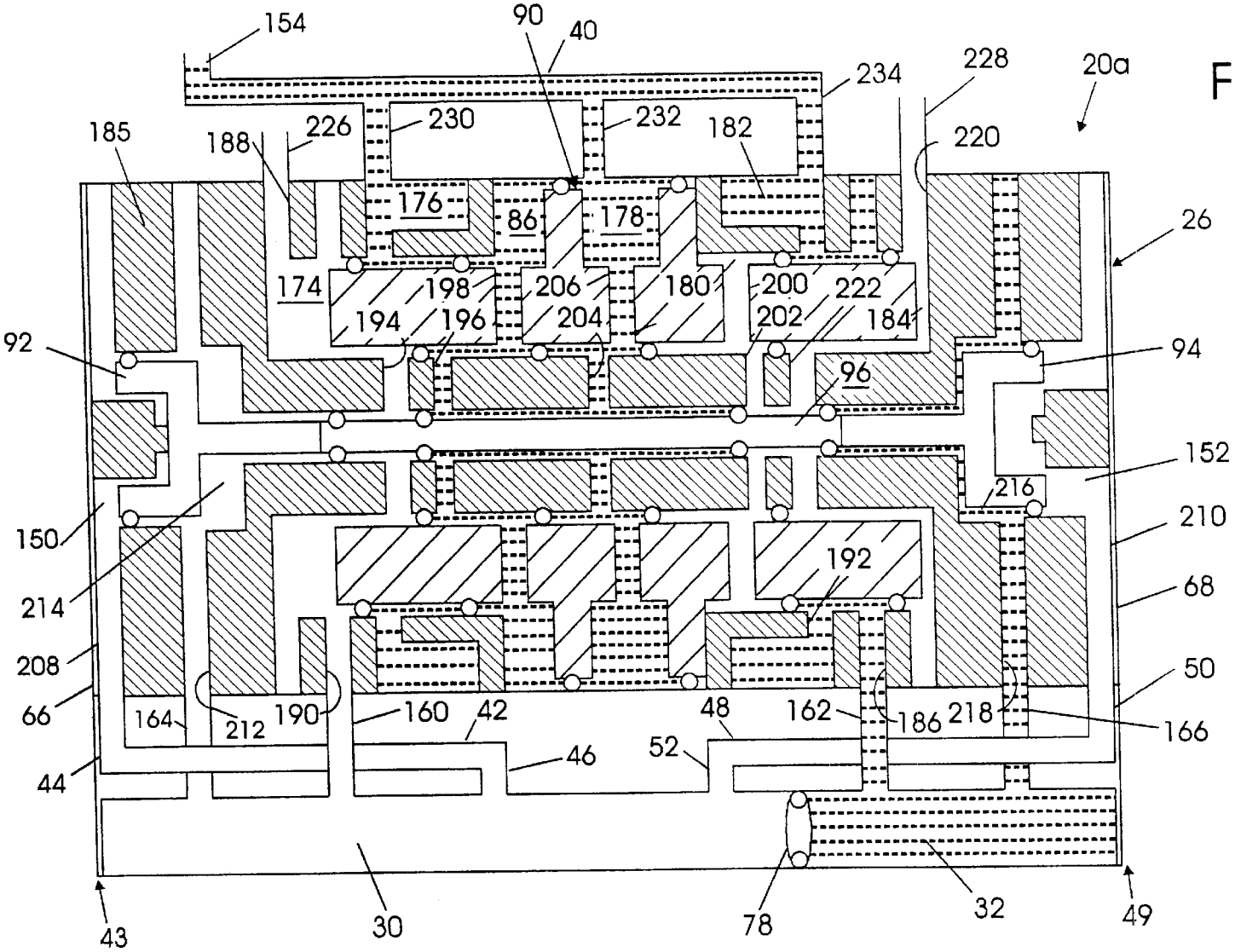

FIG. 18C shows that the downward force from chamber 86 causes the spool 90 to move down and reroute air from passage 234 via chamber 182, passages 192, 186 and 162 to pressurize chamber 32 while simultaneously exhausting chamber 30 via passages 160, 190, chamber 174, and passages 188 and 226 to the atmosphere. The differential pressure on the piston 78 resulting from the chamber 32 being at a greater pressure than the chamber 30 causes the piston 78 to change direction and move upward toward the top end 43. Chamber 150 now exhausts to atmosphere via passages 208, 44, 42, 46 and chamber 30. Chamber 214 also exhausts to atmosphere via passages 212, 164, and chamber 30, while chamber 152 exhausts to atmosphere via passages 210, 50, 48, 52, and chamber 30. Chamber 216 is pressurized by air from chamber 32 that communicates via passages 166 and 218.

Figure 18D:
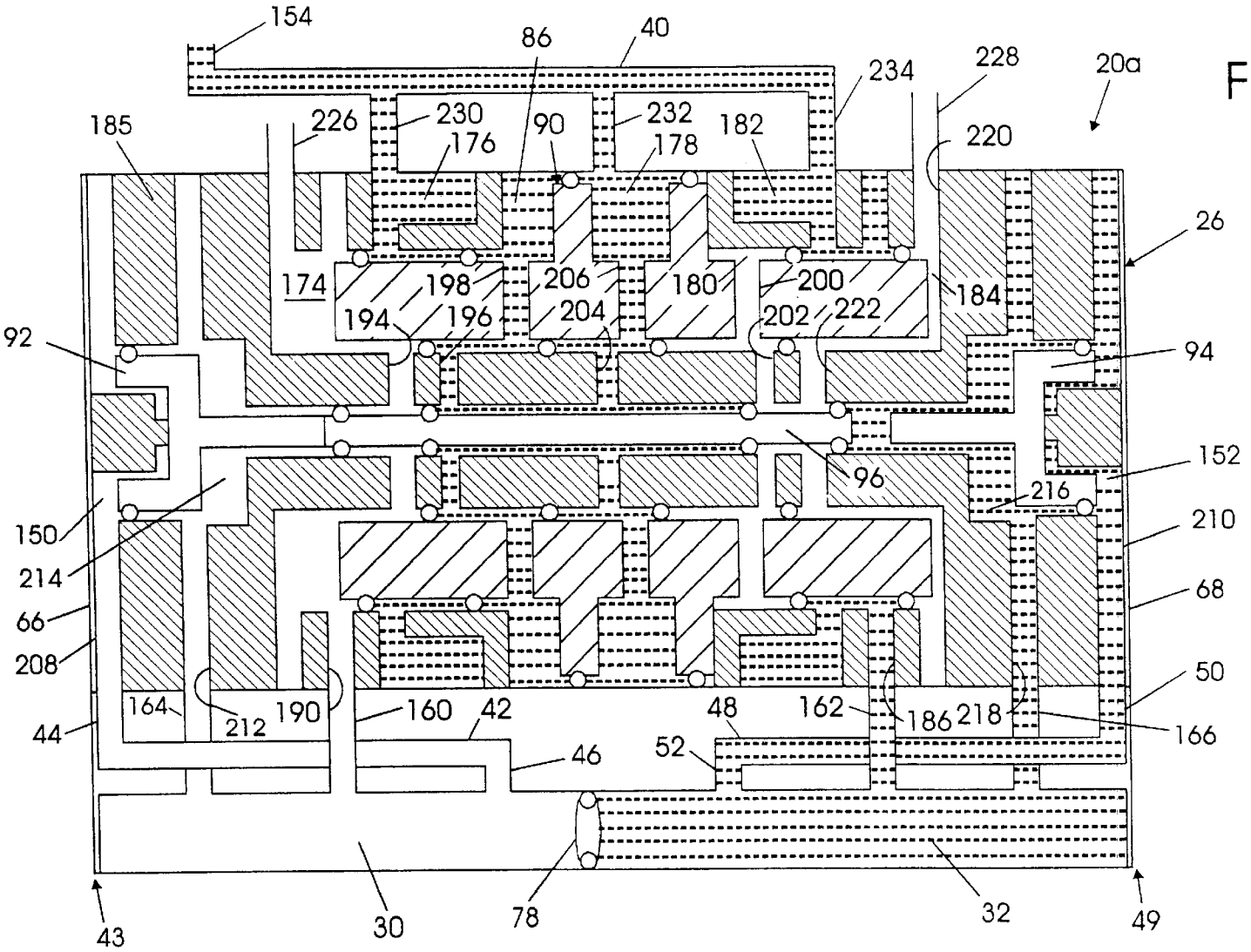

FIG. 18D shows that the pilot piston 94, under the differential pressure resulting from a pressurized chamber 216 and an exhausted chamber 152 as shown in FIG. 18C, next moves down toward the bottom end 49. Immediately after the piston 78 crosses passage 52, air communicates with chamber 152 via passages 52, 48, 50, and 210 and pilot piston 94 becomes pressurized on both sides. The piston 78 continues to move up past passage 46 and then returns to the center of the air motor, experiencing a sequence similar to that described above, completing a cycle. The piston 78 moves in a rapid reciprocating manner until the supply of air is terminated.

The air motor 20, 20*a* of the present invention has many advantages, including providing a reliable reciprocating air valve that functions well, and does not run erratically or malfunction as the result of ice formation in the valve. In addition, use of an airline oil lubricator is not necessary. When an airline lubricator is used in accordance with standard industry practice on a conventional air motor, the airline lubricator will wash out the grease within the air motor, which can cause premature failure of the air motor. If an airline lubricator is used on the air motor 20, 20*a* according to the present invention, the grease will be removed from the air motor 20, 20*a*, but this will not affect the performance of the air motor 20, 20*a*, and will not lead to premature failure. The new air motor requires minimal maintenance and runs quietly.

Although the present invention has been shown and described in considerable detail with respect to only two exemplary embodiments thereof, it should be understood by those skilled in the art that the invention should not be limited to these embodiments since various modifications, omissions and additions may be made to the disclosed embodiments without materially departing from the novel teachings and advantages of the invention, particularly in light of the foregoing teachings. For example, the passages and chambers may vary in size, shape, location, and number, and modifications may be made to the size, shape and number of the internal components. Accordingly, it is intended to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A reciprocating piston and cylinder device for driving a moveable member, comprising:

a hollow cylinder having one closed end, one end with an opening, and a longitudinal axis;

a piston disposed for axial movement within the cylinder over a range of motion, sealingly engaging the inside surface of the cylinder to define a first variable volume cavity on one side of the piston and a second variable volume cavity on the other side of the piston, the piston including a piston rod sealingly extending through the opening in the second end of the cylinder and adapted to be attached to the moveable member;

a source of fluid under pressure; and a valve assembly for alternately directing fluid to one cavity while exhausting the other cavity to cause reciprocation of the piston in the cylinder, the valve assembly comprising:

a hollow housing having a cylindrical inside surface, a longitudinal axis, and two closed ends;

a first passage between the housing and the first cavity and a second passage between the housing and the second cavity, placing the housing in continuous fluid communication with each cavity;

a substantially cylindrical main valve member that is disposed for axial movement within the housing, movable to a first position directing fluid under pressure to the first passage and exhausting the second passage and a second position directing fluid under pressure to the second passage and exhausting the first passage, the main valve member having a central bore therethrough at least a portion of which continuously communicates with the pressurized fluid source and having at least one portion with an enlarged diameter spaced from the ends of the main valve member and interposed between a smaller diameter portion at each end;

first and second variable volume fluid pressure chambers on opposite sides of the at least one enlarged diameter portion of the main valve member;

a pilot valve coaxial with and disposed substantially within the central bore of the main valve member and axially movable to a pilot valve first position for directing fluid under pressure to the first chamber and exhausting the second chamber to impel the main valve member to the main valve member first position, and movable to a pilot valve second position for directing fluid under pressure to the second chamber and exhausting the first chamber to impel the main valve member to the main valve member second position; and means for moving the pilot valve, whereby the position of the pilot valve determines the position of the main valve member, and the position of the main valve member determines which cavity is pressurized, which cavity is exhausted, and the direction of motion of the piston.

2. A reciprocating piston and cylinder device as recited in claim 1, wherein the housing and the cylinder for the piston are formed in a substantially cylindrical single body.

3. A reciprocating piston and cylinder device as recited in claim 2, further comprising:

a cover mounted to the body comprising a portion that separates from the body to define an expansion chamber for receiving exhaust, and a curved portion radially spaced from the curved outer surface of the body to form a curved exhaust flow path to direct exhaust substantially tangentially to the surface of the body for attenuating sound.

4. A reciprocating piston and cylinder device as recited in claim 1, further comprising a frame reciprocally and fixedly disposed within the housing, the frame comprising:

an exterior substantially cylindrical hollow portion that sealingly engages the housing from each end of the housing to two locations spaced from each end of the housing, leaving a central length of the housing inside surface exposed for mounting the enlarged diameter portion of the main valve member to the housing; and an interior substantially cylindrical portion with a central bore therethrough and each end having an enlarged diameter mounted to the exterior portion proximate to each end of the housing, the exterior and interior portions defining a substantially annular void formed therebetween, with passages through the interior portion placing the central bore of the interior portion in continuous fluid communication with the annular void, wherein the smaller diameter portions of the main valve member are sealingly and movably disposed within the substantially annular void defined by the frame, and the interior portion of the frame is substantially disposed in the central bore of the main valve member, and wherein the pilot valve is substantially disposed within the central bore of the interior portion of the frame.

5. A reciprocating piston and cylinder device as recited in claim 4, wherein the exterior portion of the frame comprises two exhaust adapters and the interior portion of the frame comprises two pilot adapters.

6. A reciprocating piston and cylinder device as recited in claim 4, wherein the main valve member sealingly engages the frame and the housing at a plurality of locations to form at least five chambers along the length of the main valve member in addition to the first and second chambers.

7. A reciprocating piston and cylinder device as recited in claim 6, wherein two of the chambers are continuously communicating with the source of pressurized air, three are continuously exhausted, and the first and second chambers are alternately either communicating with the source of pressurized air or exhausted.

8. A reciprocating piston and cylinder device as recited in claim 7, wherein the main valve member has two spaced enlarged diameter portions defining a central chamber that is continuously exhausted, axially interposed between the first and second chambers that alternately either communicate with the source of pressurized air or exhaust, these three chambers axially interposed between two chambers that continuously exhaust, these five chambers axially interposed between two chambers that continuously communicate with the source of pressurized air.

9. A reciprocating piston and cylinder device as recited in claim 6, wherein three of the chambers are continuously communicating with the source of pressurized air, two are continuously exhausted, and the first and second chambers are alternately either communicating with the source of pressurized air or exhausted.

10. A reciprocating piston and cylinder device as recited in claim 9, wherein the main valve member has two spaced enlarged diameter portions defining a central chamber that continuously communicates with the source of pressurized air, axially interposed between the first and second chambers that alternately either communicate with the source of pressurized air or exhaust, these three chambers axially interposed between two chambers that continuously communicate with the source of pressurized air, these five chambers axially interposed between two chambers that continuously exhaust.

11. A reciprocating piston and cylinder device as recited in claim 1, wherein the means for moving the pilot valve comprises:

a first pilot piston coaxial with and adjacent to one end of the pilot valve and responsive to pressure in the second cavity for moving the pilot valve to its first position;

a first pilot passage communicating with the second cavity to operate the first pilot piston;

a second pilot piston coaxial with and adjacent to the other end of the pilot valve and responsive to pressure in the first cavity for moving the pilot valve to its second position; and a second pilot passage communicating with the first cavity to operate the second pilot piston, wherein the hydraulic connection of the first pilot passage to the cylinder is axially interposed between the hydraulic connections of the first passage and the second pilot passage to the cylinder, and the hydraulic connection of the second pilot passage to the cylinder is axially interposed between the hydraulic connections of the first pilot passage and the second passage to the cylinder, and wherein when the piston is disposed between the first passage and the first pilot passage, the first pilot passage communicates with the second cavity to operate the first pilot piston, and when the piston is disposed between the second passage and the second pilot passage, the second pilot passage communicates with the first cavity to operate the second pilot piston.

12. A reciprocating piston and cylinder device as recited in claim 11, further comprising reset passages for resetting the pilot pistons as the main valve member initially and sequentially directs fluid under pressure to the first and second passages, the reset passages comprising:

a first reset passage for resetting the first pilot piston, the passage in fluid communication with the first passage; and a second reset passage for resetting the second pilot piston, the passage in fluid communication with the second passage.

13. A reciprocating piston and cylinder device as recited in claim 1, wherein the closed ends of the housing each include a protuberance that is received in the respective pilot piston, each protuberance maintaining a chamber at the respective end of the housing even when the pilot pistons are in their extreme outward positions.

14. A reciprocating piston and cylinder device as recited in claim 1, wherein the main valve member and pilot valve are made of acetal resin.

15. A reciprocating piston and cylinder device as recited in claim 1, wherein at least a longitudinally central portion of the main valve member central bore continuously communicates with the pressurized fluid source.

16. A valve assembly for a reciprocating piston and cylinder device, the cylinder divided into two variable volume cavities by the piston, the valve assembly for alternately directing fluid to one cavity while exhausting the other cavity to cause reciprocation of the piston in the cylinder and being in fluid communication with a source of fluid under pressure, the valve assembly comprising:

a hollow housing having a cylindrical inside surface, a longitudinal axis, and two closed ends;

a first passage between the housing and the first cavity and a second passage between the housing and the second cavity, placing the housing in continuous fluid communication with each cavity;

a substantially cylindrical main valve member that is disposed for axial movement within the housing, movable to a first position directing fluid under pressure to the first passage and exhausting the second passage and a second position directing fluid under pressure to the second passage and exhausting the first passage, the main valve member having a central bore therethrough at least a portion of which continuously communicates with the pressurized fluid source and having at least one portion with an enlarged diameter spaced from the ends of the main valve member and interposed between a smaller diameter portion at each end;

first and second variable volume fluid pressure chambers on opposite sides of the at least one enlarged diameter portion of the main valve member;

a pilot valve coaxial with and disposed substantially within the central bore of the main valve member and axially movable to a pilot valve first position for directing fluid under pressure to the first chamber and exhausting the second chamber to impel the main valve member to the main valve member first position, and movable to a pilot valve second position for directing fluid under pressure to the second chamber and exhausting the first chamber to impel the main valve member to the main valve member second position; and means for moving the pilot valve, whereby the position of the pilot valve determines the position of the main valve member, and the position of the main valve member determines which cavity is pressurized, which cavity is exhausted, and the direction of motion of the piston.

17. A reciprocating piston and cylinder device comprising:

a hollow cylinder;

a piston disposed for axial movement within the cylinder, sealingly engaging the inside surface of the cylinder to define a first variable volume cavity on one side of the piston and a second variable volume cavity on the other side of the piston;

a source of fluid under pressure;

a valve assembly for directing fluid to at least one cavity to cause reciprocation of the piston in the cylinder, the valve assembly comprising a housing having an exhaust port for discharge of fluid from the valve assembly and cylinder;

a curved outer surface of a substantially cylindrical member outside the valve assembly; and a cover mounted to the valve assembly to receive exhaust from the exhaust port, including a curved portion radially spaced from the curved surface to form a curved exhaust flow path to direct exhaust substantially tangentially to the surface of the body for attenuating sound.

18. A reciprocating piston and cylinder device as recited in claim 17, wherein the substantially cylindrical member comprises the housing and the cylinder for the piston in a single body having a longitudinal axis.

19. A reciprocating piston and cylinder device as recited in claim 18, wherein the cover further comprises a portion proximate to the exhaust port that separates from the body to define an expansion chamber for receiving and decreasing the pressure head of exhaust to attenuate sound.

20. A reciprocating piston and cylinder device as recited in claim 19, wherein the cover and expansion chamber length have respective lengths along the axis of the body that are substantially the length of the body.

21. A reciprocating piston and cylinder device as recited in claim 20, wherein the exhaust flow path has a length along the axis of the body, and the exhaust flow path length is substantially the length of the body and is substantially unobstructed.

22. A reciprocating piston and cylinder device as recited in claim 19, wherein the expansion chamber houses a muffler.

23. A reciprocating piston and cylinder device as recited in claim 17, wherein the curved portion is radially spaced from the curved outer surface of the substantially cylindrical member over an angle of up to 180 degrees.

* * * * *